US012630320B2

(12) United States Patent
Dawson

(10) Patent No.: US 12,630,320 B2
(45) Date of Patent: May 19, 2026

(54) CREATING VIRTUAL POUCH IN REUSABLE PACKAGING METHODS AND SYSTEMS

(71) Applicant: RZ CIRCULAR LTD, Alton (GB)

(72) Inventor: Thomas Andrew Dawson, Alton (GB)

(73) Assignee: RZ CIRCULAR LT, Alton (GB)

( * ) Notice: Subject to any disclaimer, the term of this patent is extended or adjusted under 35 U.S.C. 154(b) by 0 days.

(21) Appl. No.: 18/817,220

(22) Filed: Aug. 28, 2024

(65) Prior Publication Data

US 2025/0083843 A1 Mar. 13, 2025

Related U.S. Application Data

(60) Provisional application No. 63/537,074, filed on Sep. 7, 2023.

(51) Int. Cl.
*B65B 11/48* (2006.01)
*B65B 5/04* (2006.01)
(Continued)

(52) U.S. Cl.
CPC ..... *B65B 11/48* (2013.01); *B65B 5/045* (2013.01); *B65B 11/58* (2013.01); *B65B 25/20* (2013.01);
(Continued)

(58) Field of Classification Search
CPC ..... B65D 75/14; B65D 75/38; B65B 25/20; B65B 5/045; B65B 11/004; B65B 11/48;
(Continued)

(56) References Cited

U.S. PATENT DOCUMENTS 1,385,695 A * 7/1921 Maccormack ..... D06F 95/006 383/92
1,415,943 A * 5/1922 Meyers ..... A01J 27/02 426/272
(Continued)

FOREIGN PATENT DOCUMENTS

CN 106884278 A 6/2017
CN 110791942 A 2/2020
(Continued)

OTHER PUBLICATIONS

Screen captures from YouTube video clip entitled "How_to_fold_Steriking_sterilization_wrap_with_parallel-square_fold_method," 1 pages, uploaded on May 25, 2022 by user "Wipak". Retrieved from Internet: <https://www.youtube.com/watch?v=fqT7Kn4eh20> (Year: 2022).*
(Continued)

*Primary Examiner* — Joshua G Kotis
(74) *Attorney, Agent, or Firm* — TILLMAN WRIGHT, PLLC; Chad D. Tillman

(57) ABSTRACT

Packaging methods include inserting an article into a virtual pouch defined by folding and tacking a first sheet of textile material. The first sheet is then folded about the article such that the first sheet encompasses the article. A second sheet of a textile material is then folded about the first sheet into a configuration such that the second sheet entirely envelops and encloses the first sheet and the textile article. The second folded sheet is then secured in the enveloping configuration. Alternatively, the article is wrapped in and encompassed by a first sheet of textile material by folding and the resulting package is then enclosed within a virtual pouch created in a second sheet of textile material. The resulting outer sheet enclosing the inner sheet with the textile article is then secured in its enclosing configuration with a strap. The
(Continued)

packaging materials can be cleaned and decontaminated for reuse.

20 Claims, 39 Drawing Sheets

(51) Int. Cl.

| | |
|---|---|
| ***B65B 11/58*** | (2006.01) |
| ***B65B 25/20*** | (2006.01) |
| ***B65B 51/02*** | (2006.01) |
| ***B65B 51/07*** | (2006.01) |
| ***B65B 51/10*** | (2006.01) |
| ***B65B 55/06*** | (2006.01) |
| ***B65D 75/14*** | (2006.01) |
| ***B65D 75/38*** | (2006.01) |
| ***B65D 85/18*** | (2006.01) |
| *B65B 51/04* | (2006.01) |
| *B65B 51/06* | (2006.01) |
| *B65D 65/22* | (2006.01) |

(52) U.S. Cl.
CPC ..... *B65B 55/06* (2013.01); *B65D 75/14* (2013.01); *B65D 75/38* (2013.01); *B65B 51/02* (2013.01); *B65B 51/04* (2013.01); *B65B 51/06* (2013.01); *B65B 51/07* (2013.01); *B65B 51/10* (2013.01); *B65B 2220/16* (2013.01); *B65D 65/22* (2013.01); *B65D 85/18* (2013.01)

(58) Field of Classification Search
CPC ..... B65B 11/58; B65B 2220/16; B65B 67/08; A61B 2050/314; A61B 2050/318; D06F 95/006
See application file for complete search history.

(56) References Cited

U.S. PATENT DOCUMENTS

| | | | | | |
|---|---|---|---|---|---|
| 2,620,964 | A * | 12/1952 | Rose | B65B 11/58 | 229/87.01 |
| 4,022,139 | A | 5/1977 | Carson | | |
| 4,160,601 | A | 7/1979 | Jacobs | | |
| 4,705,171 | A * | 11/1987 | Eldridge | A61F 15/001 | 53/461 |
| 5,118,203 | A | 6/1992 | Andronico | | |
| 5,222,600 | A | 6/1993 | Stoddard et al. | | |
| 5,373,798 | A | 12/1994 | Price et al. | | |
| 5,548,942 | A * | 8/1996 | Zajec | B65B 11/04 | 53/465 |
| 5,836,243 | A | 11/1998 | Ackley | | |
| 5,975,298 | A | 11/1999 | Sankey et al. | | |
| 6,151,869 | A * | 11/2000 | Weder | A01G 5/04 | 53/461 |
| 7,003,934 | B1 * | 2/2006 | Yano | B29C 66/81435 | 53/552 |
| 2001/0036519 | A1 * | 11/2001 | Bayer | B32B 3/04 | 428/35.2 |
| 2002/0142178 | A1 * | 10/2002 | Yamashita | C23C 22/05 | 156/334 |
| 2004/0057636 | A1 * | 3/2004 | Ishizaki | B65D 81/2038 | 383/44 |
| 2004/0205879 | A1 | 10/2004 | Leba | | |
| 2005/0173274 | A1 | 8/2005 | Gammons | | |
| 2005/0196075 | A1 * | 9/2005 | Heidel | D06F 95/006 | 383/117 |
| 2006/0104856 | A1 * | 5/2006 | Farrell | A61L 2/208 | 422/1 |
| 2006/0113411 | A1 * | 6/2006 | Buckley | A61J 7/0007 | 241/100 |
| 2006/0170913 | A1 | 8/2006 | Burke et al. | | |
| 2007/0026472 | A1 * | 2/2007 | Prokash | A61L 2/07 | 435/7.32 |
| 2007/0095699 | A1 * | 5/2007 | Frieze | A61L 2/26 | 206/438 |
| 2007/0207451 | A1 | 9/2007 | Perner | | |
| 2008/0002182 | A1 | 1/2008 | Akkerman et al. | | |
| 2008/0031551 | A1 | 2/2008 | Jones | | |
| 2008/0276966 | A1 | 11/2008 | Yusef et al. | | |
| 2011/0062038 | A1 * | 3/2011 | Kyritsis | A61B 50/24 | 206/459.1 |
| 2012/0018335 | A1 | 1/2012 | Sanchez et al. | | |
| 2012/0222603 | A1 | 9/2012 | Hishida et al. | | |
| 2013/0165837 | A1 * | 6/2013 | Addison | A61F 13/0283 | 602/44 |
| 2014/0259450 | A1 | 9/2014 | Alexander et al. | | |
| 2014/0312078 | A1 | 10/2014 | Fitzsimmons et al. | | |
| 2015/0033673 | A1 * | 2/2015 | Lien | A61F 15/001 | 53/461 |
| 2015/0034521 | A1 * | 2/2015 | Lien | B65B 67/08 | 53/460 |
| 2016/0107814 | A1 * | 4/2016 | Fitzwater | B65D 31/10 | 229/87.01 |
| 2016/0332803 | A1 | 11/2016 | Fisher | | |
| 2017/0129684 | A1 * | 5/2017 | Pini | B65D 81/22 | |
| 2018/0137738 | A1 | 5/2018 | Glasgow et al. | | |
| 2019/0345659 | A1 | 11/2019 | Hombroek et al. | | |
| 2020/0063077 | A1 * | 2/2020 | Nolan | B65D 83/08 | |
| 2020/0248361 | A1 | 8/2020 | Bae et al. | | |
| 2021/0040667 | A1 | 2/2021 | Kessler et al. | | |
| 2021/0108361 | A1 | 4/2021 | De Bruijn et al. | | |
| 2021/0161335 | A1 | 6/2021 | Rahn et al. | | |
| 2022/0151477 | A1 | 5/2022 | Morrison | | |
| 2023/0168261 | A1 | 6/2023 | Brettle et al. | | |
| 2023/0301378 | A1 | 9/2023 | Godwin | | |

FOREIGN PATENT DOCUMENTS

| | | | | |
|---|---|---|---|---|
| FR | 1429897 | A * | 2/1966 | B65B 11/58 |
| JP | 2013215564 | A * | 10/2013 | |
| WO | 2014098608 | A1 | 12/2014 | |
| WO | 2022271156 | A1 | 12/2022 | |

OTHER PUBLICATIONS

Google translation CN 106884278A, accessed on Feb. 7, 2026.
Google translation CN 110791942A, accessed on Feb. 7, 2026.

* cited by examiner

190

190

190

CREATING VIRTUAL POUCH IN REUSABLE PACKAGING METHODS AND SYSTEMS

COPYRIGHT STATEMENT

Any new and original work of authorship in this document is subject to copyright protection under the copyright laws of the United States and other countries. Reproduction by anyone of this document as it appears in official governmental records is permitted, but otherwise all other copyright rights whatsoever are reserved.

BACKGROUND OF THE INVENTION

The invention generally relates to packaging methods and systems that include reusable packaging materials that are capable of being cleaned and decontaminated by washing and/or heating for reuse in the packaging methods and systems and, more particularly, to such methods and systems in which a virtual pouch is created.

A recent development in packaging methods and systems related to the present invention comprises a two-phase packaging method. In the first phase, a textile article is inserted through an open end of a bag into an interior space of the bag. The open end of the bag is then closed such that the bag completely contains the item within the interior space. The bag comprises a textile material that defines the interior space of the bag.

Referring to the drawings, FIGS. 1A-1E serve to illustrate this first phase. Specifically, FIG. 1A shows a textile article 102 for inserting into a bag 104, and FIG. 1B shows the textile article 102 being inserted through an open end 106 of the bag 104. FIG. 9 is a top perspective view of the textile article 102, which in this example comprises a clean room boot. FIG. 1C shows the bag 104 completely containing the textile article 102 within the interior space of the bag. FIG. 1D shows the closing off of the open end 106 of the bag 104 by rolling the bag at 108. FIG. 1E shows the tying off of the rolled end of the bag 104 using straps 110,112 in order to secure the bag in the closed configuration of FIG. 1E.

Following the packaging of the textile article in the bag, the bag is packaged in the second phase by folding a sheet of a textile material around the bag to enclose the bag. The sheet is folded about the bag into a configuration such that the folded sheet of textile material defines an envelope that entirely envelops the bag. The folded sheet of material is then secured in the configuration enveloping the bag using an elongate length of a textile material, which length may be a strap, band, or tie.

Referring again to the drawings, FIGS. 2-8 serve to illustrate this second phase. FIG. 2 illustrates the bag 104 of FIG. 1E being placed on top of a textile sheet 114 that has been laid generally flat on a surface. The textile sheet 114 is folded at fold lines 116,118 shown in FIG. 3; at fold lines 120,122 shown in FIG. 4; at fold lines 124,126 shown in FIG. 5; and at fold lines 128,130 in FIG. 6. Tape 132 or other fasteners are used to attach the folded textile sheet 114 to itself to hold the folds at least temporarily, as shown in FIG. 7, which is a view of the folded sheet 114 opposite the view of FIG. 6. A textile strap is then used to band or otherwise secure the folded sheet 114 in its folded configuration enveloping the bag, as shown in FIG. 8.

The textile article, the textile bag, the textile sheet to be folded to define the envelope, and the textile strap are capable of being washed, heated, or washed and heated for cleaning and decontamination, whether in the same process or different processes. Indeed, it is contemplated that each can be decontaminated separately or together, and that they can be decontaminated before packaging or after packaging. The textile article, the textile bag, the textile sheet to be folded to define the envelope, and the textile strap thus can be reused, including in a subsequent repackaging of the textile article, with minimal recurring packaging waste, if any.

Beneficially, the decontaminated textile sheet in which the bag is wrapped can be used to provide a decontaminated surface on which to place the textile article when unpackaging it. Preferably, the entire package is placed on a surface and the strap is untied or otherwise unfastened. The decontaminated outer sheet is unwrapped and laid flat on the surface with the bag exposed. The bag is then untied and the textile article is removed and placed on the decontaminated sheet ready for use, all without any contamination of the textile article.

The textile material of each of the textile article, the textile bag, the textile sheet, and the textile strap, may comprise at least one of nylon, polyester, cotton, flax, and hemp, and in some embodiments each of these is made from the same textile material. The textile material of any or all of these may be water repellant, semi-impermeable to water, or impermeable to water. Furthermore, the textile material of any or all of these may be coated with a hydrophobic substance such as, for example, a wax. In some embodiments, the textile material of any or all of these is coated with a wax as a waterproofing agent. In some embodiments, the textile material of any or all of these is coated with a member of the C6 fluorocarbon family or C6 fluorotelomers.

Such methods and systems are believed to be environmentally friendly and promote sustainability. Certainly, waste is avoided and space conserved at landfills when packaging materials are reused and not discarded. Such methods and systems also are believed to be well suited in the foodservices and healthcare industries. For example, the textile article may comprise an apron or a head covering required by food safety regulations when handling, preparing, or serving food. The textile article also may comprise a gown, a surgical drape, scrubs, a sanitary piece of textile clothing worn by a healthcare provider, or a sanitary piece of textile clothing worn by a healthcare patient. All of these items can be cleaned and decontaminated along with the packaging materials for reuse with the same intended purposes.

For additional understanding of this recent development, reference is here made to U.S. provisional patent application 63/472,295 filed on Jun. 11, 2023, the disclosure of which is hereby incorporated herein by reference.

While the foregoing described methods and systems are believed to be much needed environmentally friendly methods and systems, it is believed that one or more needs continue to exist for further improvements in such methods and systems. At least one or more aspects and features of the invention are believed to represent such needed improvements in these methods and systems.

SUMMARY OF THE INVENTION

The invention includes many aspects and features.

In an aspect of the invention, a packaging method comprises inserting a textile article into an open end of a virtual pouch that is defined by folding and tacking a first sheet of textile material. The first sheet of textile material is then folded about the textile article to encompass the textile article such that the textile article is completely enveloped within the first sheet. A second sheet of a textile material is then folded about the first sheet into a configuration such that the second sheet entirely envelops the first sheet. The second sheet is then secured in the configuration enveloping the first sheet, with the first sheet defining the virtual pouch with the textile article received therein. An elongate length of a textile material, such as a strap, band, or tie (hereinafter "strap"), preferably is used to band or otherwise secure the second sheet in this configuration.

In variations of this method, the virtual pouch is created either prior to this packaging process, with the textile article being inserted into the virtual pouch during the packaging process, or the virtual pouch is actually created around the textile article during the packaging process. The virtual pouch preferably comprises a pouch without any corners where debris may be trapped. The virtual pouch is preferably dimensioned to act as a static fixation point to minimize movement in the wrapping during processing, transport and storage.

In a feature of this aspect, the first textile sheet and the second textile sheet are interchangeable. In some preferred embodiments, each sheet is rectangular and has the same dimensions and is made from the same material.

Furthermore, the textile article, the first and second textile sheets, and the textile strap are capable of being washed, heated, or washed and heated for cleaning and decontamination, whether in the same process or different processes. Indeed, it is contemplated that each can be decontaminated separately or together, and that they can be decontaminated before packaging or after packaging. The textile article, the textile sheets, and the textile strap thus can be reused, including in a subsequent repackaging of the textile article, with minimal recurring packaging waste, if any.

In a feature, the first textile sheet is folded and tacked in creating the virtual pouch. Preferably, stitching or an adhesive is used for tacking that is later dissolvable, such as in the cleaning or decontamination process.

In additional features of this aspect, the textile material of each of the textile article, the textile bag, the textile sheet, and the textile strap, may comprise at least one of nylon, polyester, cotton, flax, and hemp, and in some embodiments each of these is made from the same textile material. The textile material of any or all of these may be water repellant, semi-impermeable to water, or impermeable to water. Furthermore, the textile material of any or all of these may be coated with a hydrophobic substance such as, for example, a wax. The textile material of any or all of these also may be coated with a member of the C6 fluorocarbon family or C6 fluorotelomers. In another feature, the textile material of any or all of these is coated with a wax as a waterproofing agent.

In another aspect of the invention, a packaging method comprises: (a) inserting a textile article into an open end of a virtual pouch that is defined by folding a first sheet of textile material; (b) subsequently, folding the first sheet about the textile article such that the textile article is entirely encompassed within the virtual pouch; (c) subsequently, folding a second sheet of a textile material about the first sheet such that the second sheet entirely wraps around and encloses the first sheet while the first sheet encompassing the textile article; and (d) subsequently, securing the second sheet in its disposition wrapped around and enclosing the first sheet with the textile article.

In a feature, the method further comprises a preliminary step of decontamination of one or more of the first sheet, the second sheet, and the textile article.

In a feature, the method further comprises a subsequent step of decontaminating the package resulting from steps (a)-(d). The decontamination may be performed by washing the package, by heating the package, or both.

In a feature, step (d) is performed using an elongate piece of textile material.

In a feature, the method further comprises a preliminary step of decontaminating the elongate piece of textile material.

In a feature, a plurality of textile articles are inserted or otherwise disposed in a virtual pouch.

In a feature, one or more folds are made around the textile article.

In a feature, one or more folds are made before the textile article is disposed within the virtual pouch.

In a feature, before performing steps (a)-(d), the first sheet and the second sheet are interchangeable. Preferably, before creating the virtual pouch, both the first sheet and the second sheet are the same with respect to structure and material.

In a feature, the virtual pouch is secured by tacking one or more folds made in the first sheet in creating the virtual pouch. The tacking may be performed by stitching, gluing, or welding. In some embodiments, stitching is performed using a thread that is dissolvable in a cleaning or decontamination process. The tacking may be performed by single-point stitching, double-point stitching, or continuous stitching on either one side or opposite sides of the virtual pouch. In some embodiments, tacking is performed using an adhesive that is dissolvable in a cleaning or decontamination process. The tacking also may be performed by using other fasteners, including push studs, buttons, clips, zippers, and tongue and groove locks. Such fasteners can reduce recurring packaging waste and ensure consistency in the dimensions of the virtual pouch.

In another feature, all components are made from the same textile material and the packaging method is part of a mono-material packing system.

In a feature, the textile material of any of the textile article, the first and second sheets, and the textile length comprises at least one of nylon, polyester, cotton, flax, and hemp.

In a feature, the textile material of any of the textile article, the first sheet and second sheets, and the textile length is water repellant, semi-impermeable to water, or impermeable to water.

In a feature, the textile material of any of the textile article, the first sheet and second sheets, and the textile length is coated with a hydrophobic substance such as, for example, a wax.

In a feature, the textile material of any of the textile article, the first sheet and second sheets, and the textile length is coated with a member of the C6 fluorocarbon family or C6 fluorotelomers.

In a feature, the textile material of any or all of these is coated with a wax as a waterproofing agent.

In another aspect of the invention, a packaging method comprises: (a) folding a first sheet of a textile material about a textile article such that the first sheet entirely wraps around and encompasses the textile article; (b) subsequently, inserting the first sheet with the encompassed textile article into an open end of a virtual pouch that is defined by folding a second sheet of textile material; (c) subsequently, folding the second sheet such that the first sheet with the encompassed textile article is entirely enclosed within the virtual pouch; and (d) subsequently, securing the second sheet in its disposition wrapped around and enclosing the first sheet and the textile article.

In a feature, the method further comprises a preliminary step of decontaminating one or more of the first sheet, the second sheet, and the textile article.

In a feature, the method further comprises a subsequent step of decontaminating the package resulting from steps (a)-(d). The decontamination may be performed by washing the package, by heating the package, or both.

In a feature, step (d) is performed using an elongate piece of textile material.

In a feature, the method further comprises a preliminary step of decontaminating the elongate piece of textile material.

In a feature, a plurality of textile articles are inserted or otherwise located in a virtual pouch.

In a feature, in creating the virtual pouch, one or more folds are made in the second sheet around the first sheet.

In a feature, one or more folds are made in the second sheet in creating the virtual pouch before enclosing the first sheet and the textile article within the virtual pouch.

In a feature, before performing steps (a)-(d), the first sheet and the second sheet are interchangeable.

In a feature, the virtual pouch is secured by tacking one or more folds made in the second sheet in creating the virtual pouch. The tacking may be performed by stitching, gluing, or welding. In some embodiments, stitching is performed using a thread that is dissolvable in a cleaning or decontamination process. The tacking may be performed by single-point stitching, double-point stitching, or continuous stitching on either one side or opposite sides of the virtual pouch. In some embodiments, tacking is performed using an adhesive that is dissolvable in a cleaning or decontamination process. The tacking also may be performed by using other fasteners, including push studs, buttons, clips, zippers, and tongue and groove locks.

In a feature, the textile material of any of the textile article, the first sheet, the second sheet, and the textile sheet comprises at least one of nylon, polyester, cotton, flax, and hemp.

In a feature, the textile material of any of the textile article and the first and second sheets is water repellant, semi-impermeable to water, or impermeable to water.

In a feature, the textile material of any of the textile article and the first and second sheets is coated with a hydrophobic substance such as, for example, a wax.

In a feature, the textile material of any of the textile article and the first and second sheets is coated with a member of the C6 fluorocarbon family or C6 fluorotelomers.

In a feature, the textile material of any of the textile article and the first and second sheets is coated with a wax as a waterproofing agent.

Another aspect comprises a package resulting from any of the foregoing methods, wherein the textile article comprises a textile article used in foodservice such as an apron or head covering.

Another aspect comprises a package resulting from any of the foregoing methods, wherein the textile article comprises a textile article used in healthcare such as a gown, a surgical drape, scrubs, a sanitary piece of textile clothing worn by a healthcare provider, or a sanitary piece of textile clothing worn by a healthcare patient.

Another aspect comprises a package resulting from any of the foregoing methods, wherein the package does not comprise a bag.

Another aspect comprises a package resulting from any of the foregoing methods.

This packaging method and systems in accordance with one or more aspects and features of the invention are believed to represent one or more improvements over the above-described systems and methods that utilize textile bags because the folded sheets that are used to create the virtual pouches are simpler and less costly to make than the textile bags, and because greater efficiencies can be realized when the two textile sheets of a package are interchangeable for purposes of performing the packaging.

In addition to the aforementioned aspects and features of the invention, it should be noted that the invention further encompasses the various logical combinations and subcombinations of such aspects and features. Thus, for example, claims in this or a divisional or continuing patent application or applications may be separately directed to any aspect, feature, or embodiment disclosed herein, or combination thereof, without requiring any other aspect, feature, or embodiment.

BRIEF DESCRIPTION OF THE DRAWINGS

One or more preferred embodiments of the invention now will be described in detail with reference to the accompanying drawings, wherein the same elements are referred to with the same reference numerals, and wherein.

DETAILED DESCRIPTION

Figure 1A:
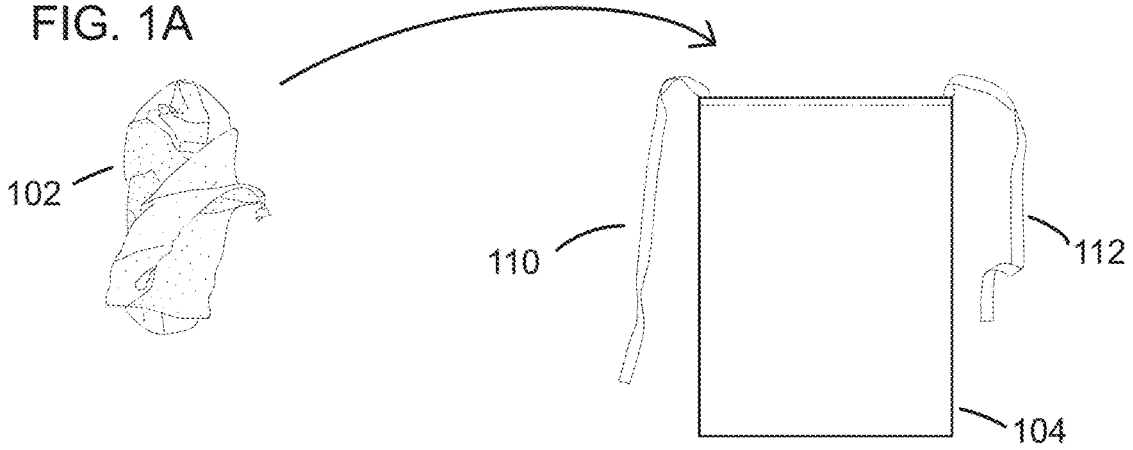
FIGS. 1A-1E illustrate a first phase in the packaging of an article in a recent development in packaging methods and systems that include reusable packaging materials that are capable of being cleaned and decontaminated by washing and/or heating for reuse in the packaging methods and systems.
Figure 1B:
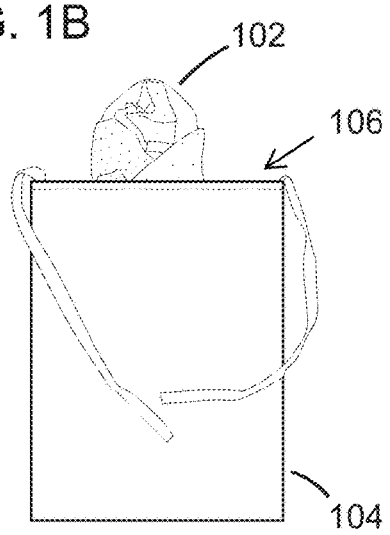
Figure 1C:
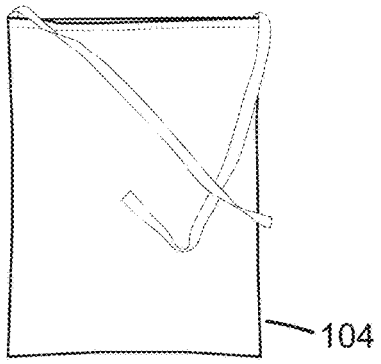
Figure 1D:
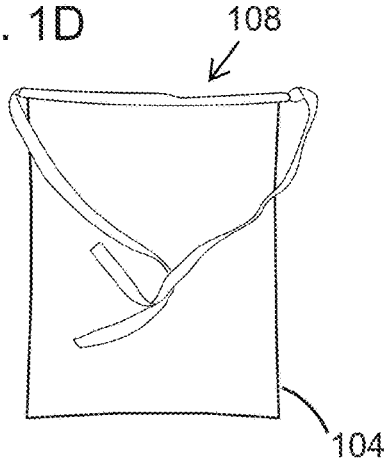
Figure 1E:
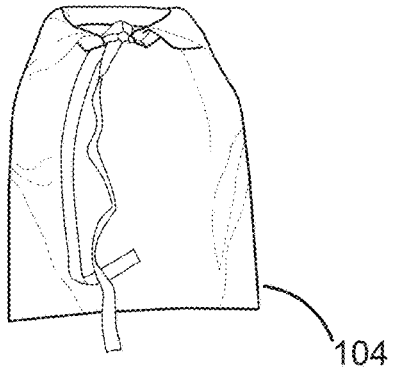
Figure 2:
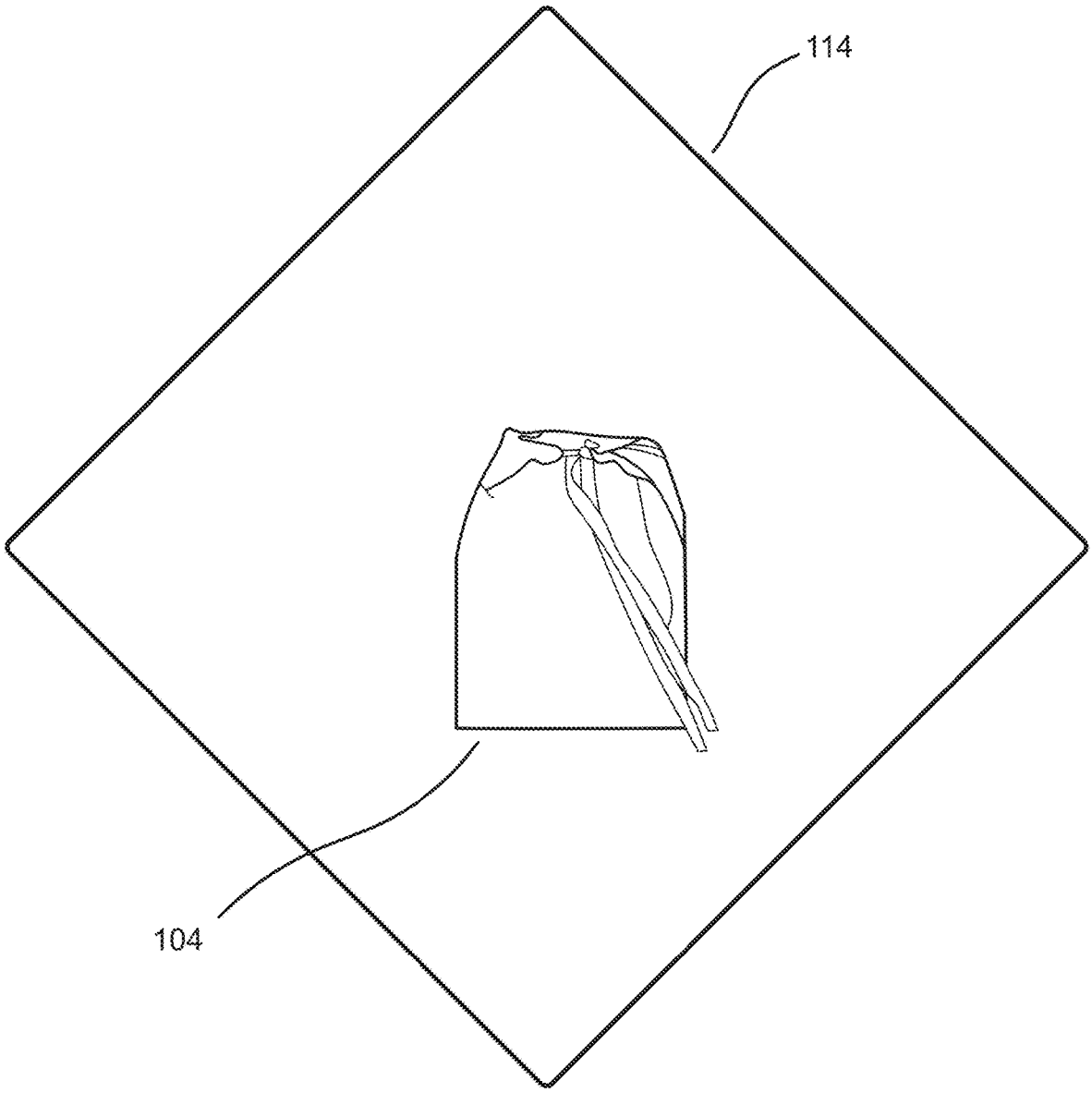
FIGS. 2-8 illustrate a second phase following the first phase of FIGS. 1A-1E in the packaging of the article.
Figure 3:
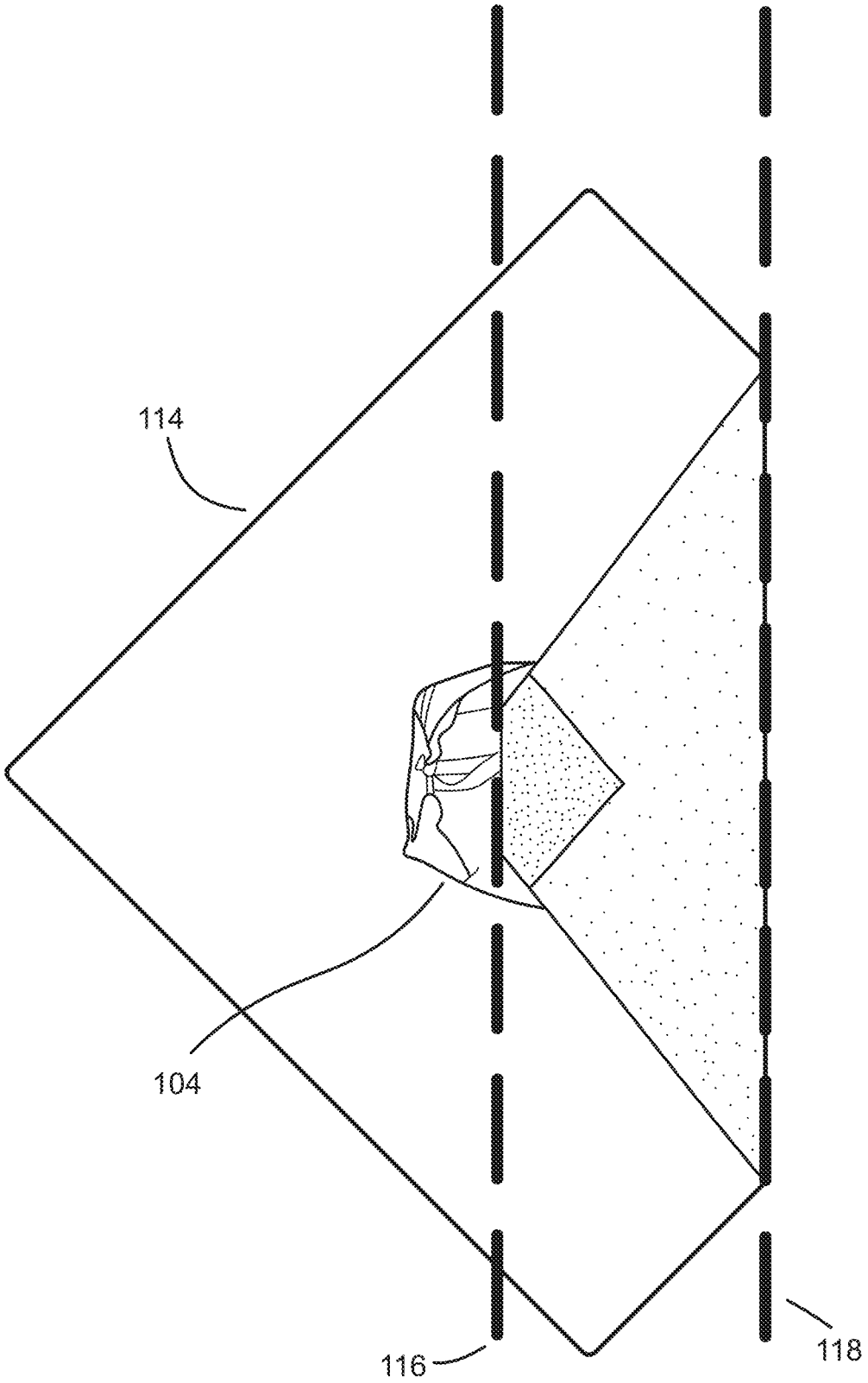
Figure 4:
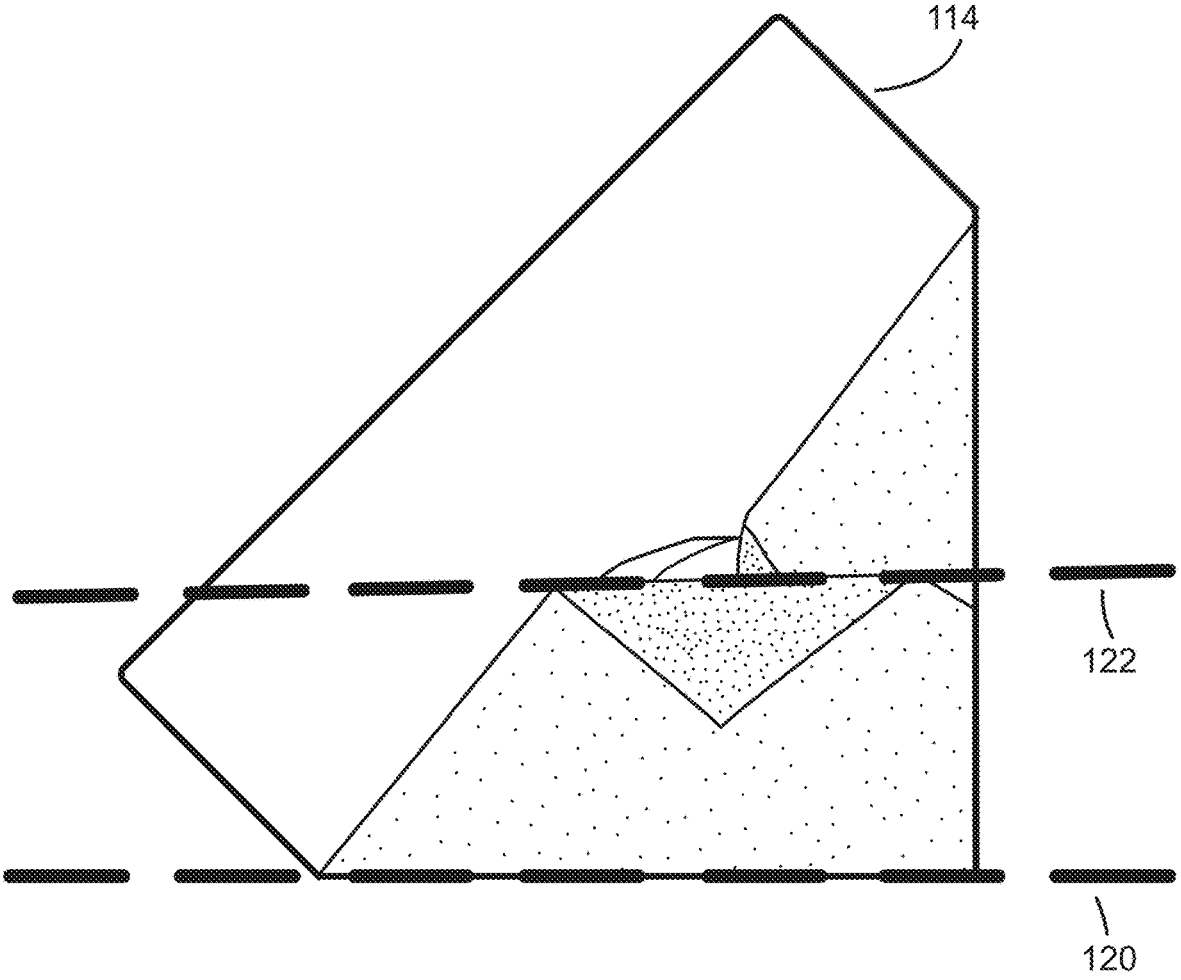
Figure 5:
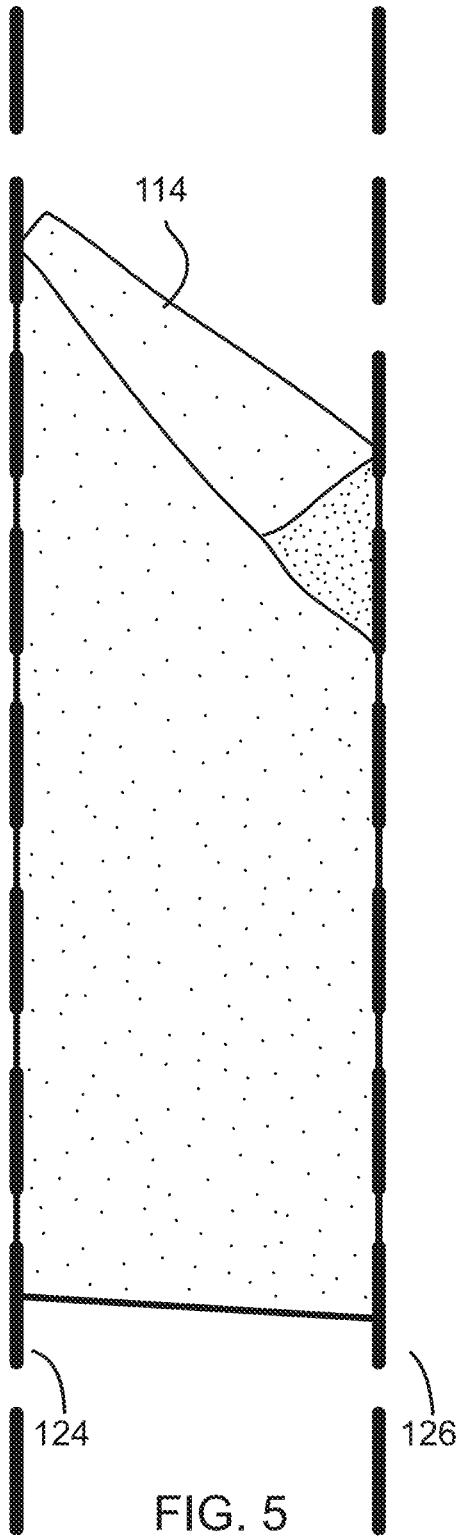
Figure 6:
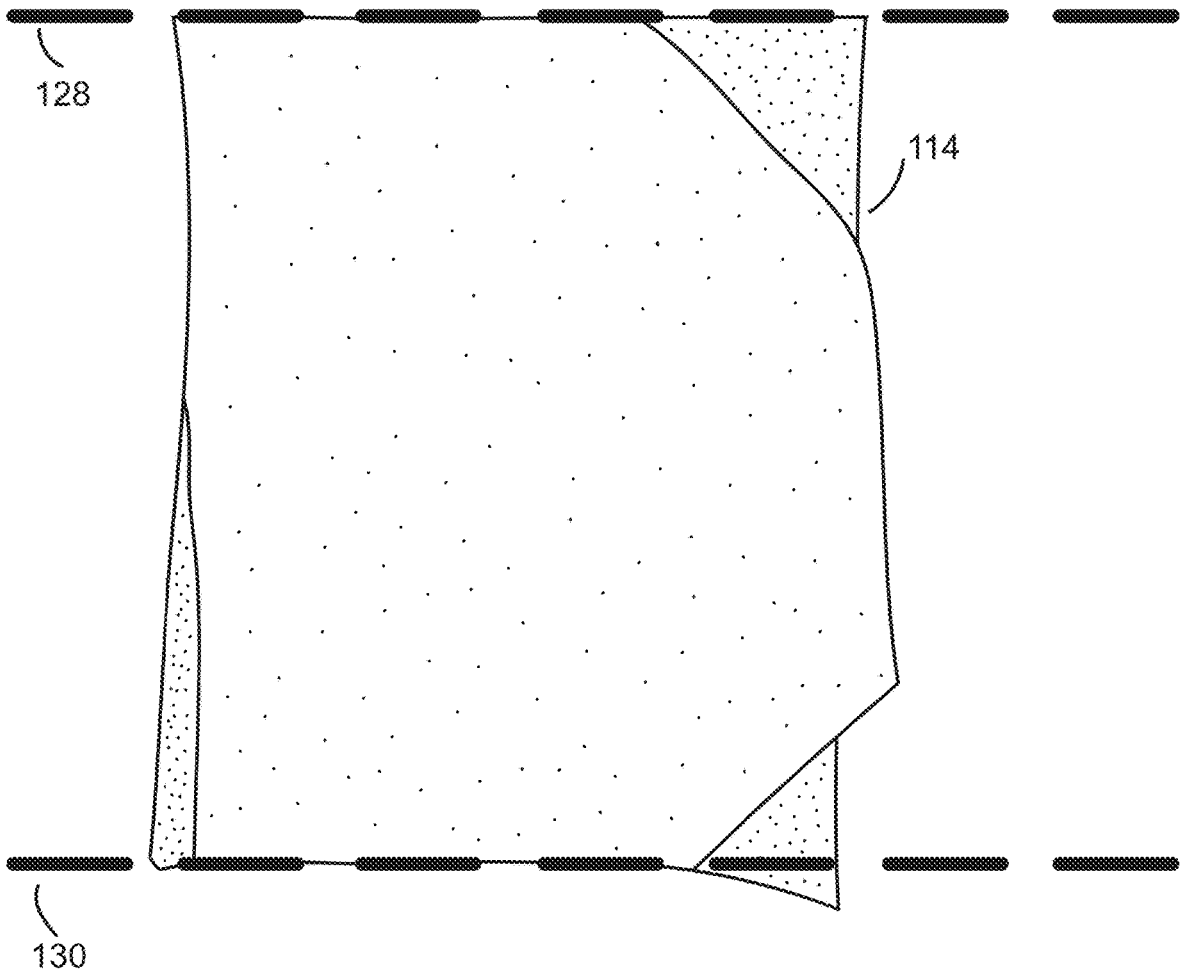
Figure 7:
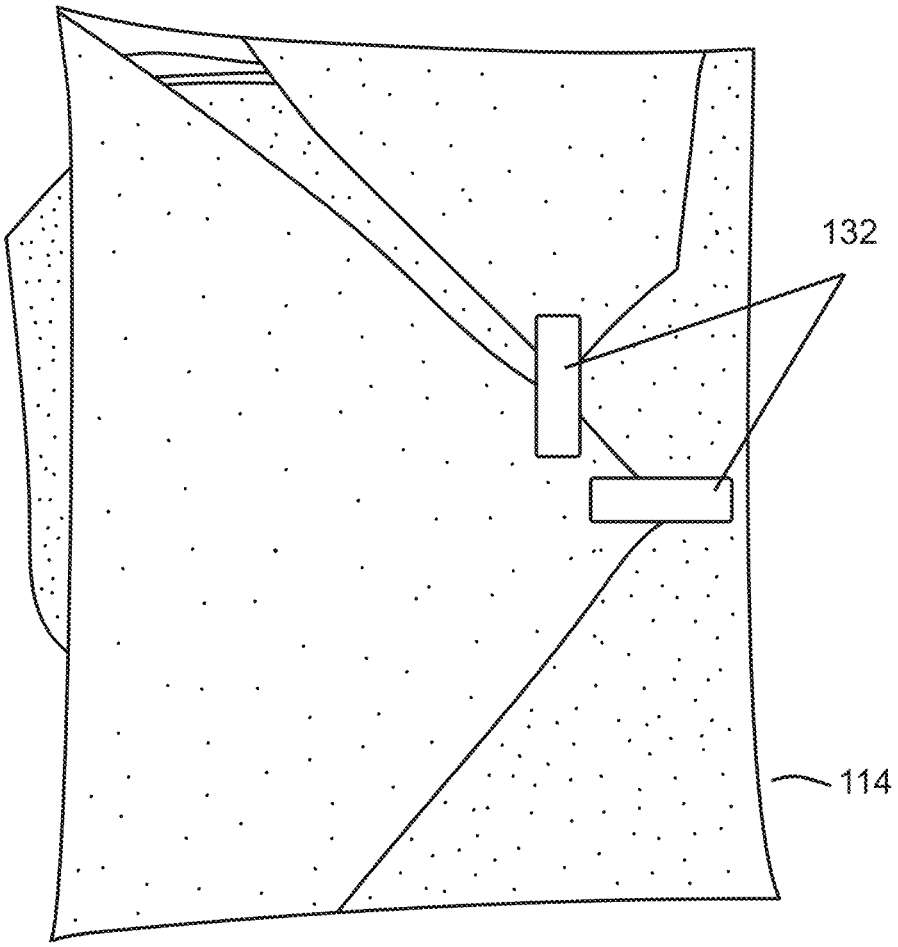
Figure 8:
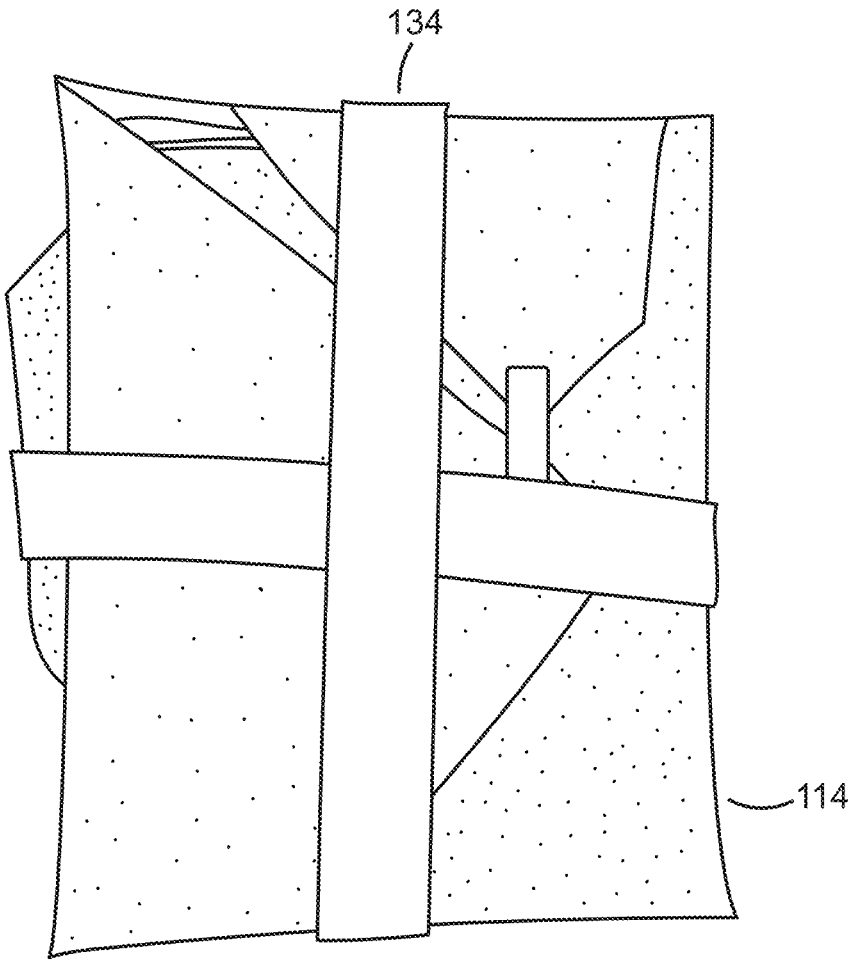

As a preliminary matter, it will readily be understood by one having ordinary skill in the relevant art ("Ordinary Artisan") that the invention has broad utility and application. Furthermore, any embodiment discussed and identified as being "preferred" is considered to be part of a best mode contemplated for carrying out the invention. Other embodiments also may be discussed for additional illustrative purposes in providing a full and enabling disclosure of the invention. Furthermore, an embodiment of the invention may incorporate only one or a plurality of the aspects of the invention disclosed herein; only one or a plurality of the features disclosed herein; or combination thereof. As such, many embodiments are implicitly disclosed herein and fall within the scope of what is regarded as the invention.

Accordingly, while the invention is described herein in detail in relation to one or more embodiments, it is to be understood that this disclosure is illustrative and exemplary of the invention and is made merely for the purposes of providing a full and enabling disclosure of the invention. The detailed disclosure herein of one or more embodiments is not intended, nor is to be construed, to limit the scope of patent protection afforded the invention in any claim of a patent issuing here from, which scope is to be defined by the claims and the equivalents thereof. It is not intended that the scope of patent protection afforded the invention be defined by reading into any claim a limitation found herein that does not explicitly appear in the claim itself.

Thus, for example, any sequence(s) and/or temporal order of steps of various processes or methods that are described herein are illustrative and not restrictive. Accordingly, it should be understood that, although steps of various processes or methods may be shown and described as being in a sequence or temporal order, the steps of any such processes or methods are not limited to being carried out in any particular sequence or order, absent an indication otherwise. Indeed, the steps in such processes or methods generally may be carried out in various different sequences and orders while still falling within the scope of the invention. Accordingly, it is intended that the scope of patent protection afforded the invention be defined by the issued claim(s) rather than the description set forth herein.

Additionally, it is important to note that each term used herein refers to that which the Ordinary Artisan would understand such term to mean based on the contextual use of such term herein. To the extent that the meaning of a term used herein—as understood by the Ordinary Artisan based on the contextual use of such term—differs in any way from any particular dictionary definition of such term, it is intended that the meaning of the term as understood by the Ordinary Artisan should prevail.

With regard solely to construction of any claim with respect to the United States, no claim element is to be interpreted under 35 U.S.C. 112 (f) unless the explicit phrase "means for" or "step for" is actually used in such claim element, whereupon this statutory provision is intended to and should apply in the interpretation of such claim element. With regard to any method claim including a condition precedent step, such method requires the condition precedent to be met and the step to be performed at least once but not necessarily every time during performance of the claimed method.

Furthermore, it is important to note that, as used herein, "comprising" is open-ended insofar as that which follows such term is not exclusive. Additionally, "a" and "an" each generally denotes "at least one" but does not exclude a plurality unless the contextual use dictates otherwise. Thus, reference to "a picnic basket having an apple" is the same as "a picnic basket comprising an apple" and "a picnic basket including an apple", each of which identically describes "a picnic basket having at least one apple" as well as "a picnic basket having apples"; the picnic basket further may contain one or more other items beside an apple. In contrast, reference to "a picnic basket having a single apple" describes "a picnic basket having only one apple"; the picnic basket further may contain one or more other items beside an apple. In contrast, "a picnic basket consisting of an apple" has only a single item contained therein, i.e., one apple; the picnic basket contains no other item.

When used herein to join a list of items, "or" denotes "at least one of the items" but does not exclude a plurality of items of the list. Thus, reference to "a picnic basket having cheese or crackers" describes "a picnic basket having cheese without crackers", "a picnic basket having crackers without cheese", and "a picnic basket having both cheese and crackers"; the picnic basket further may contain one or more other items beside cheese and crackers.

When used herein to join a list of items, "and" denotes "all of the items of the list". Thus, reference to "a picnic basket having cheese and crackers" describes "a picnic basket having cheese, wherein the picnic basket further has crackers", as well as describes "a picnic basket having crackers, wherein the picnic basket further has cheese"; the picnic basket further may contain one or more other items beside cheese and crackers.

The phrase "at least one" followed by a list of items joined by "and" denotes an item of the list but does not require every item of the list. Thus, "at least one of an apple and an orange" encompasses the following mutually exclusive scenarios: there is an apple but no orange; there is an orange but no apple; and there is both an apple and an orange. In these scenarios if there is an apple, there may be more than one apple, and if there is an orange, there may be more than one orange. Moreover, the phrase "one or more" followed by a list of items joined by "and" is the equivalent of "at least one" followed by the list of items joined by "and".

Additionally, as used herein, "decontamination" refers to the neutralization or removal of dangerous substances, radioactivity, or germs from an area or object, and may include sterilization or disinfection. Decontamination may be performed by a number of techniques, including heating, application of a sterilizing gas, and radiation. Decontamination also may be performed during and as part of cleaning, including washing.

Referring now to the drawings, one or more preferred embodiments of the invention are next described. The following description of one or more preferred embodiments is merely exemplary in nature and is in no way intended to limit the invention, its implementations, or uses.

Figure 9:
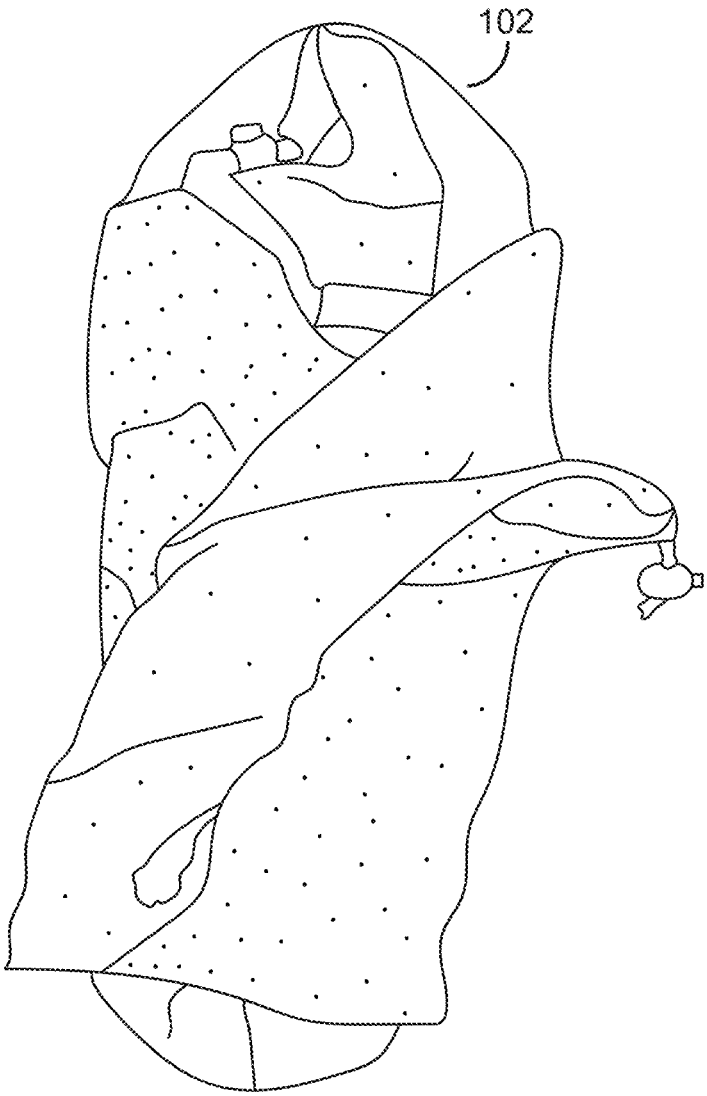
FIG. 9 illustrates an exemplary article for packaging.
Figure 10:
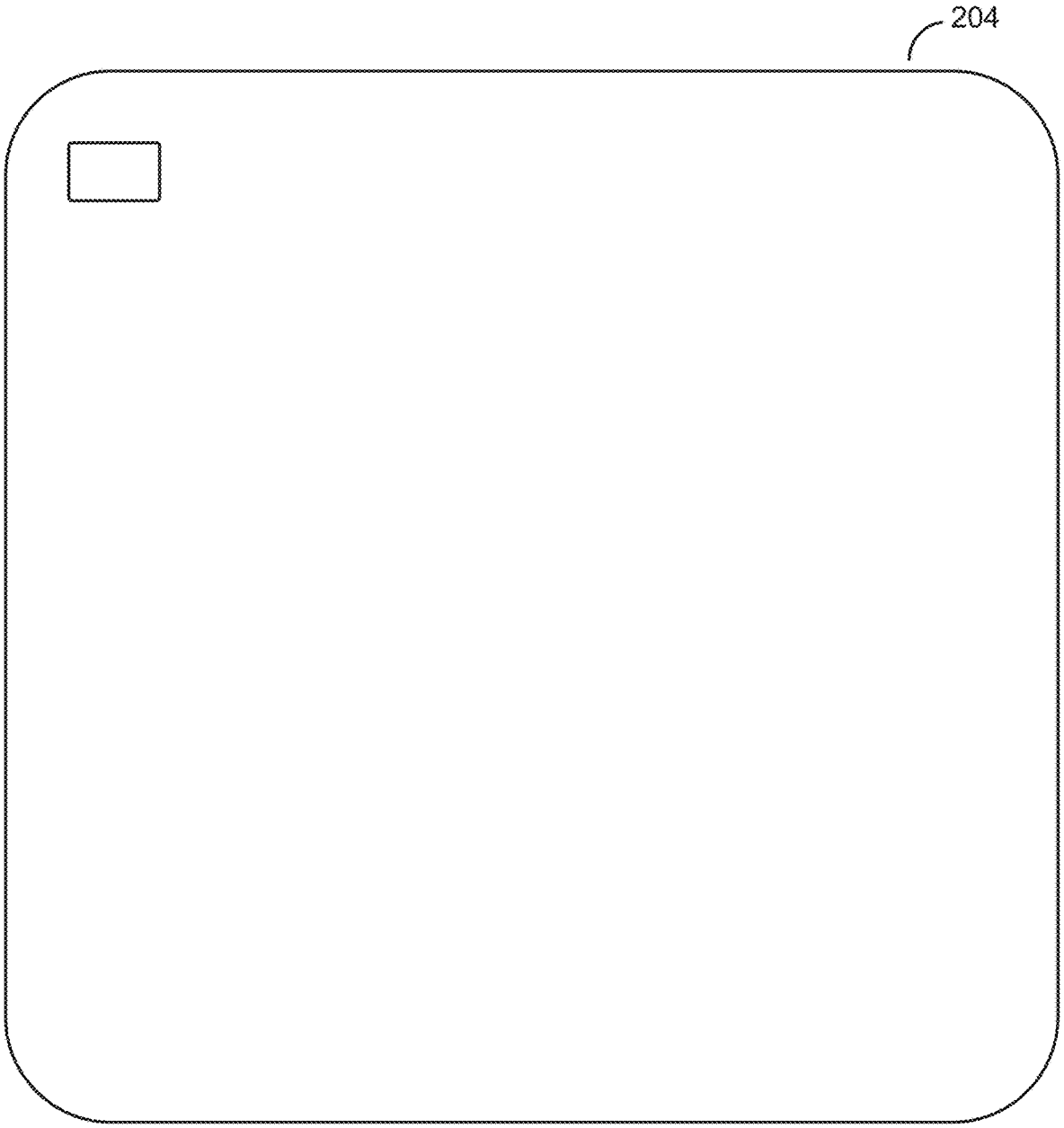
FIG. 10 illustrates a sheet of textile material 204 that may be used as the first sheet or the second sheet in embodiments in accordance with one or more aspects and features of the invention.

FIG. 9 illustrates an exemplary article 102 for packaging in one or more embodiments in accordance with one or more aspects and features of the invention, and FIG. 10 illustrates a sheet of textile material 204 that may be used as the first sheet or the second sheet in one or more embodiments in accordance with one or more aspects and features of the invention. Exemplary embodiments will now be described.

Figure 11:
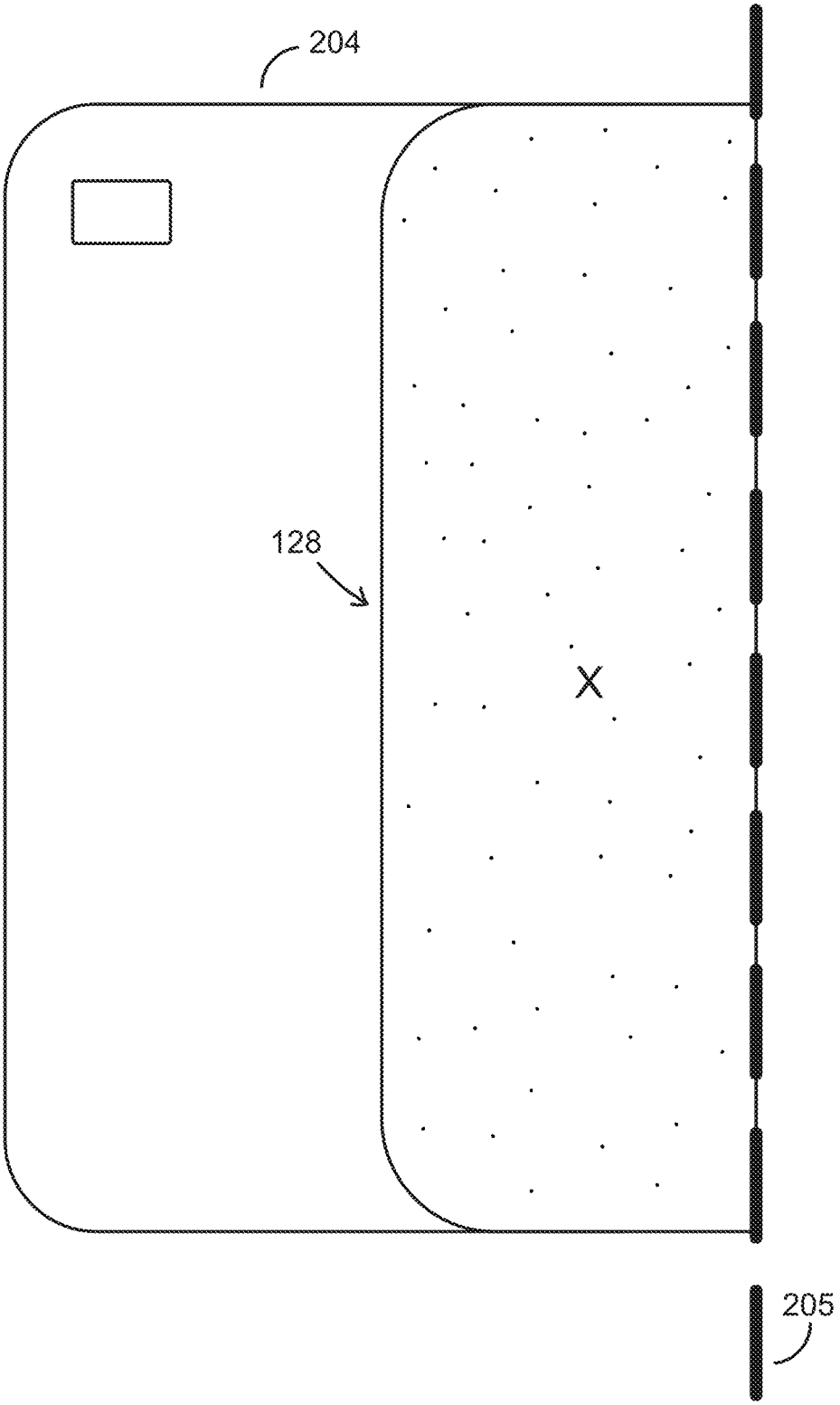
FIG. 11 illustrates the textile sheet of FIG. 10 for use as the first sheet 204, wherein the textile sheet 204 has been folded about a fold line 205 for creating a virtual pouch 128 in the area generally designated by X.
Figure 12:
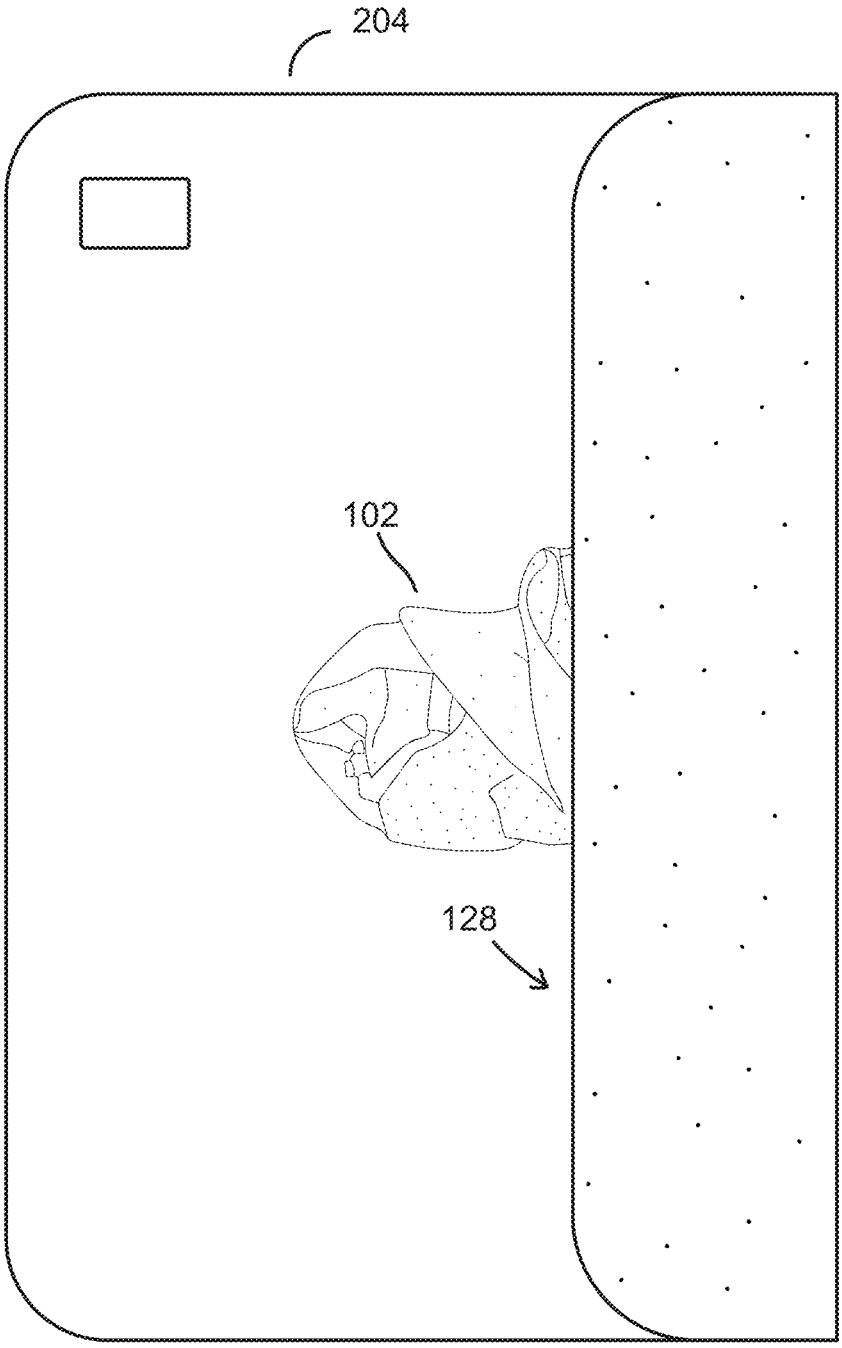
FIG. 12 illustrates placement of a textile article 102 under the folded section of the first sheet 204 of FIG. 11 for creating the virtual pouch.

FIG. 11 illustrates the textile sheet 204 of FIG. 10 for use as the first textile sheet 204. In this regard, the textile sheet 204 has been folded about fold line 205 in FIG. 11 in creating a virtual pouch 128 indicated generally in the area X. The folding may be performed before the textile article is inserted into the virtual pouch or may be performed around the textile article during formation of the virtual pouch. The former variation is illustrated in FIG. 11, wherein the textile sheet 204 has been folded about the fold line 205 for creating a virtual pouch in the area generally designated by X. FIG. 12 illustrates the subsequent placement of the textile article 102 under the folded section of the first textile sheet 204 within the virtual pouch 128.

Figure 13:
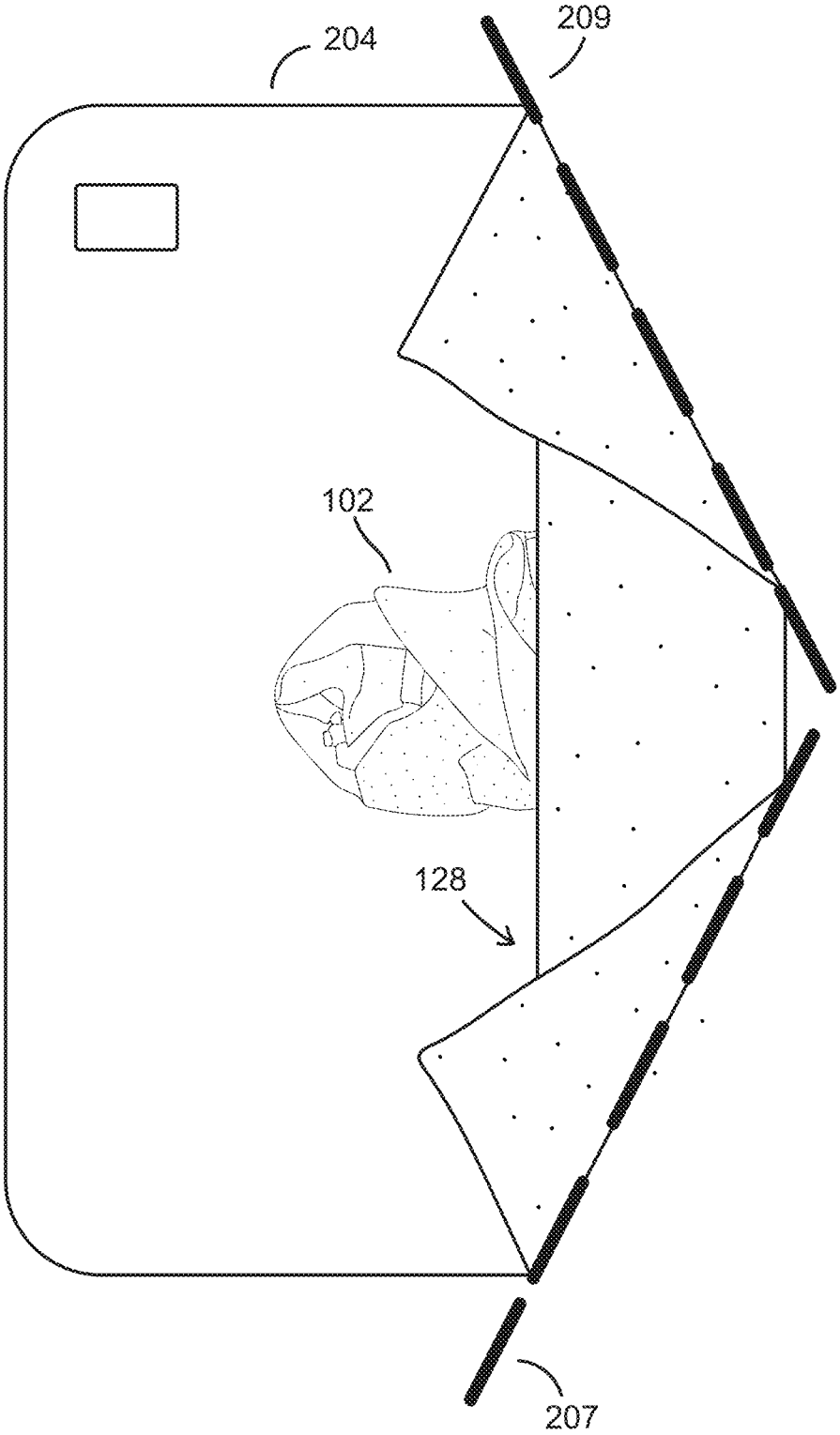
FIG. 13 illustrates the textile sheet 204 of FIG. 12, wherein the textile sheet 204 has been further folded about fold lines 207,209 around the textile article 102 for creating the virtual pouch.

FIG. 13 illustrates the textile sheet 204 of FIG. 12, wherein the textile sheet 204 has been further folded about fold lines 207,209 for creating the virtual pouch around the textile article 102. It will be appreciated that by folding around the textile article, a more tailored fit of the virtual pouch may be achieved.

Figure 14:
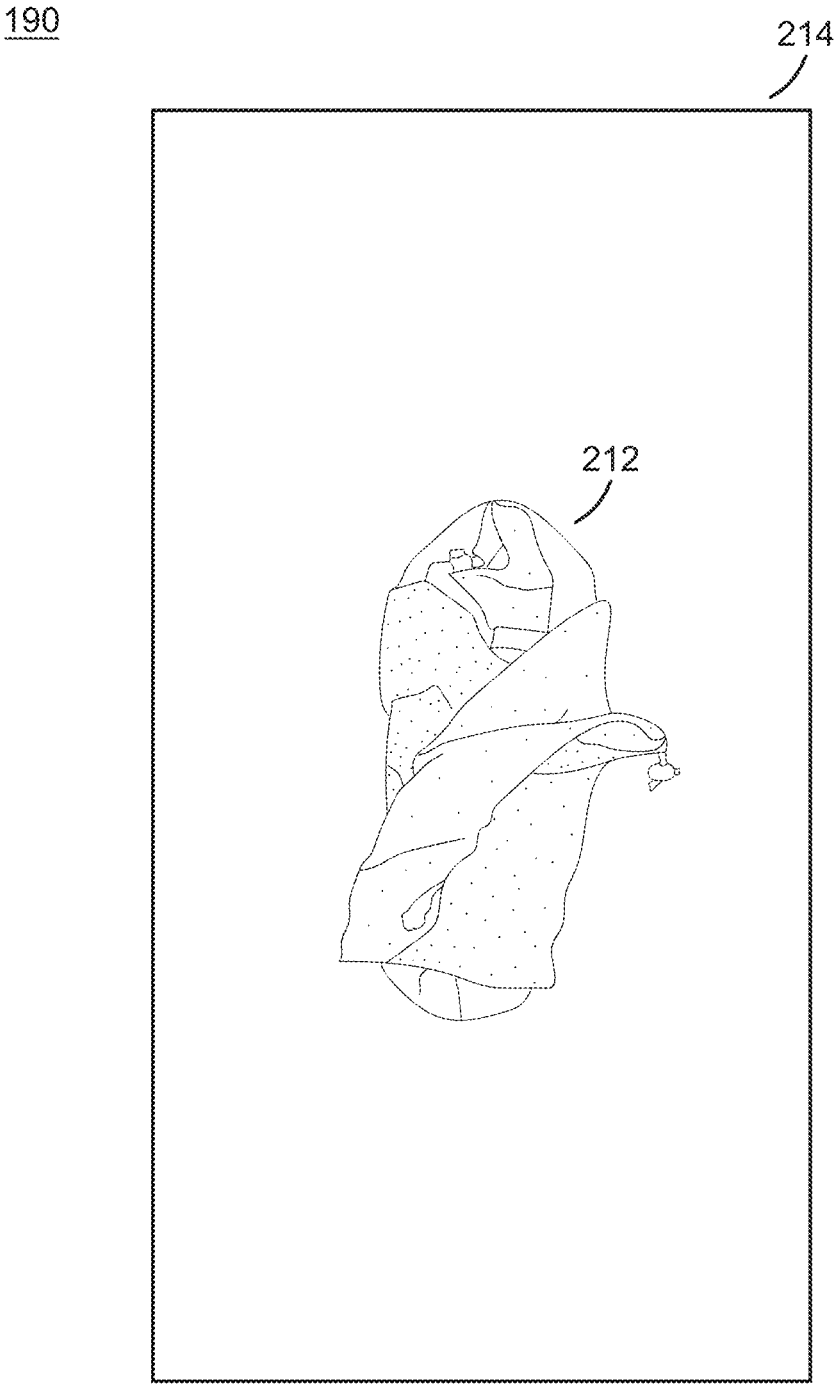
FIG. 14 illustrates a textile article 212 that has been placed on top of a textile sheet 214 that has been laid flat on a surface 190 and is being used as the first sheet in another embodiment in accordance with one or more aspects and features of the invention, wherein a virtual pouch is to be entirely formed about the article 212.
Figure 15:
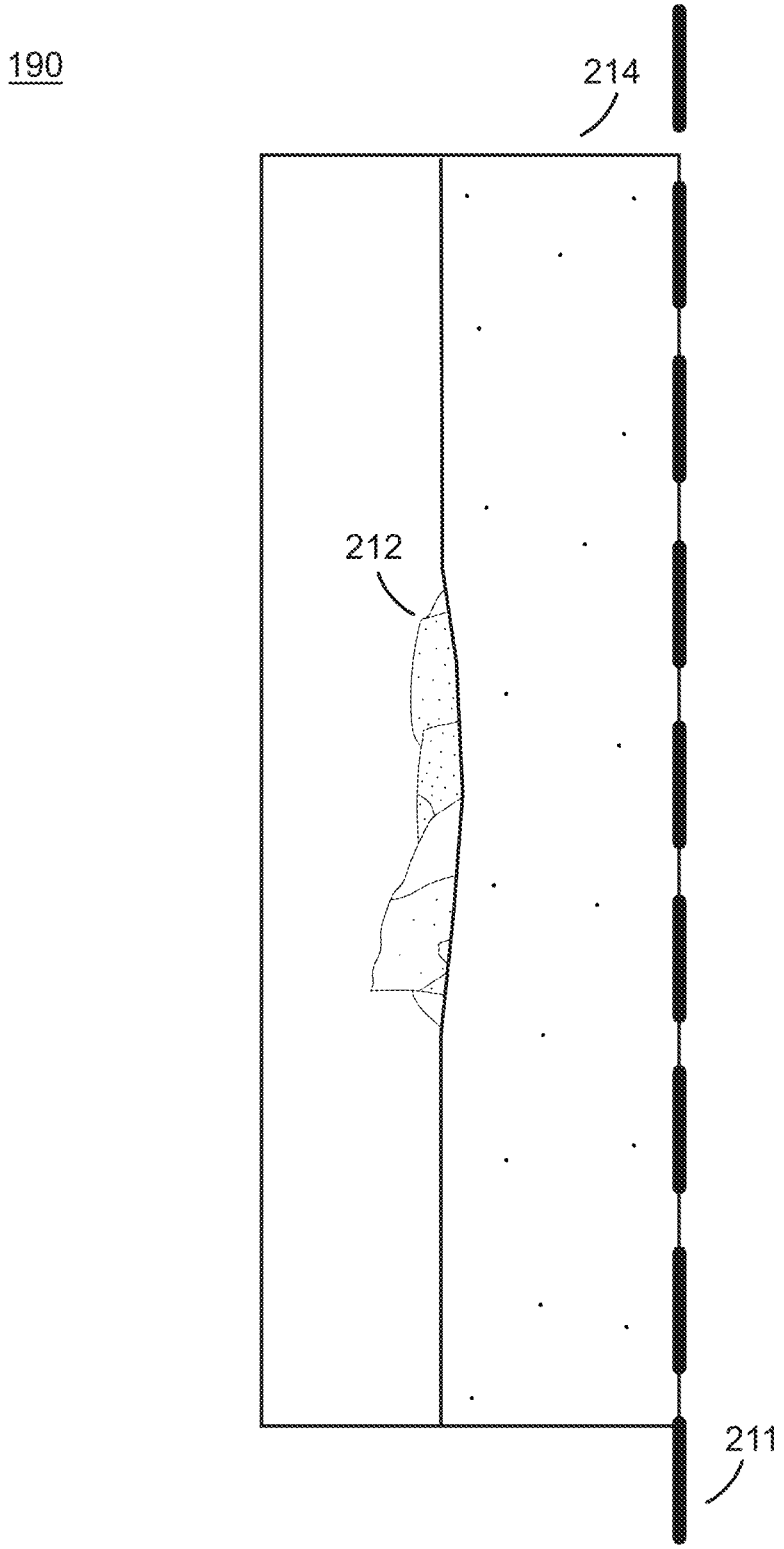
FIG. 15 illustrates the textile sheet 214 of FIG. 14, wherein the textile sheet 214 has been folded about fold line 211 for creating the virtual pouch around the textile article 212.
Figure 16:
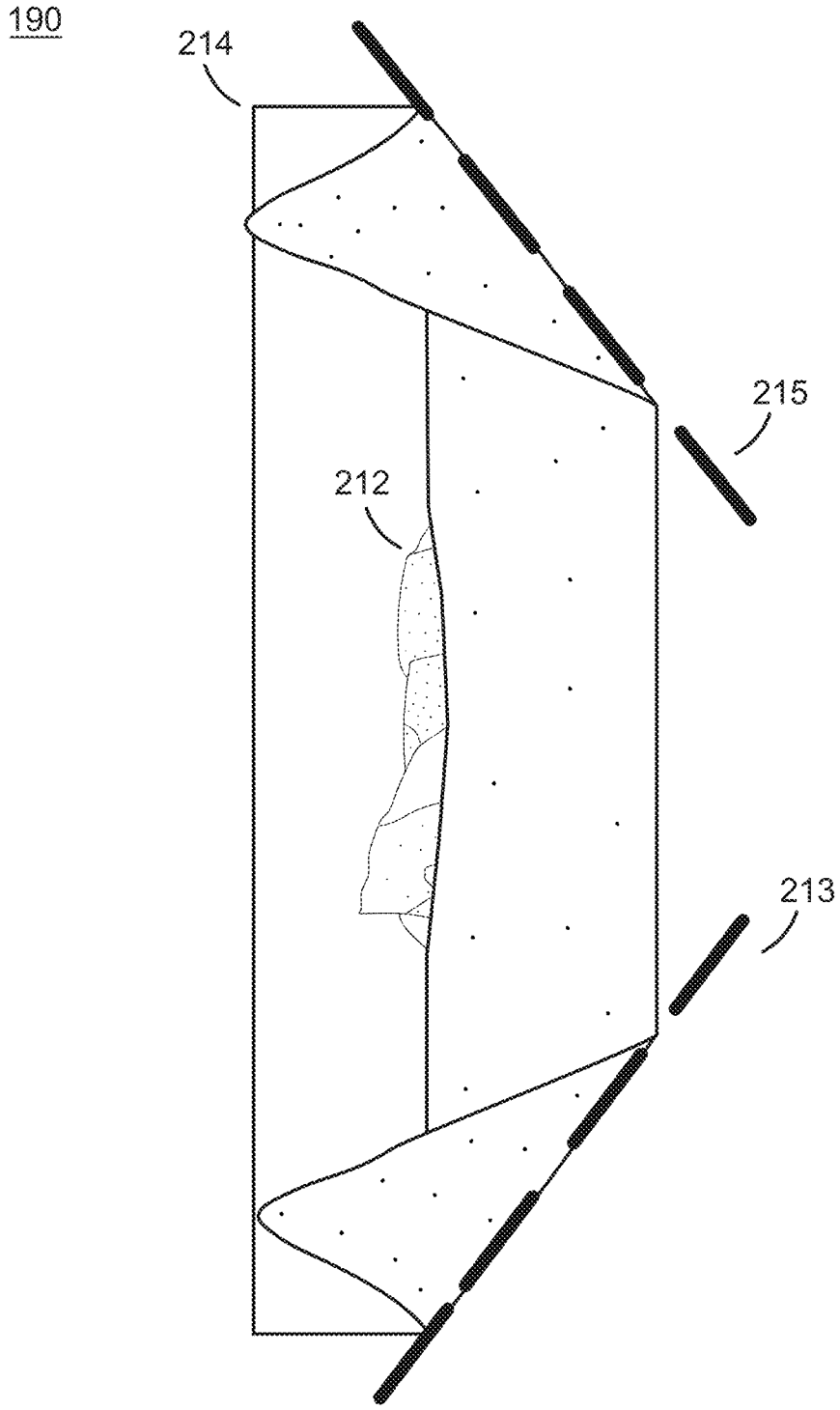
FIG. 16 illustrates the textile sheet 214 of FIG. 15, wherein the textile sheet 214 has been further folded about fold lines 213,215 for creating the virtual pouch around the textile article 212.

Another example of folding around the textile article, this time from the very start, is illustrated with reference to FIGS. 14-16. FIG. 14 illustrates a textile article 212 that has been placed on top of a textile sheet 214 that has been laid flat on a surface 190 and that is being used as the first sheet in another embodiment in accordance with one or more aspects and features of the invention, wherein a virtual pouch is to be entirely formed about the article 212. FIG. 15 illustrates the textile sheet 214 of FIG. 14, wherein the textile sheet 214 has been folded about fold line 211 for creating the virtual pouch around the textile article 212; and FIG. 16 illustrates the textile sheet 214 of FIG. 15, wherein the textile sheet 214 has been further folded about fold lines 213,215 for creating the virtual pouch about the article with a more tailored fit to the particular textile article 212.

So that the first textile sheet does not partially or completely unfold and thereby degrade the integrity of the virtual pouch, whether during the packaging process and/or during subsequent unpacking of the textile article for use, the first textile sheet preferably is tacked.

Tacking preferably is performed using, for example, stitching, tape, or an adhesive. The tacking preferably is temporary and lasts for a single packaging use. The tacking can then be utilized again when the materials are reused. It is believed that this can provide efficiencies if the textile sheet is interchangeable for use as either the first textile sheet or the second textile sheet. Moreover, in some embodiments stitching using a dissolvable thread is used such that the tacking dissolves in subsequent washing of the textile material for cleaning and reuse. Similarly, in some embodiments a dissolvable adhesive is used that dissolves in subsequent washing of the textile material for cleaning and reuse.

Figure 17:
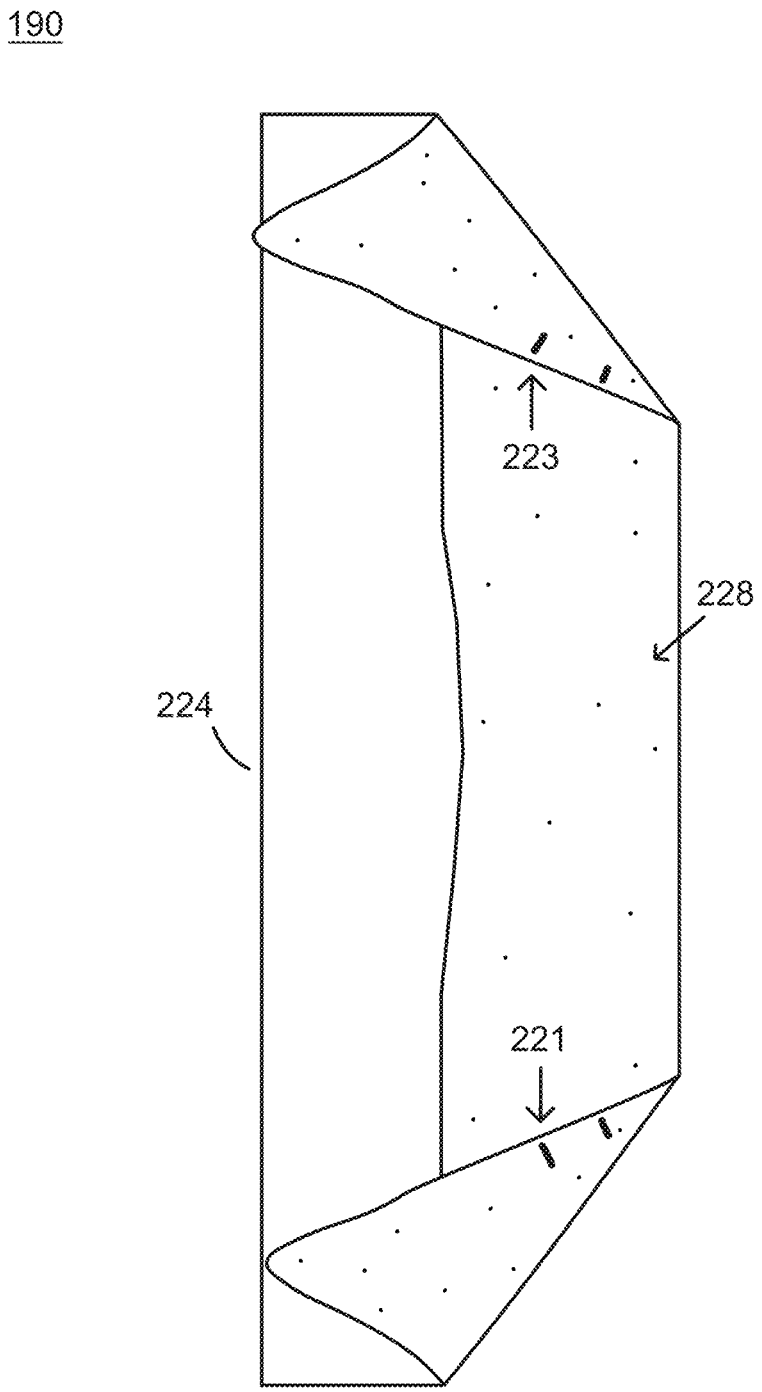
FIG. 17 illustrates tacking at locations 221,223 of a textile sheet 224 that is being used as the first sheet in another embodiment in accordance with one or more aspects and features of the invention, wherein a virtual pouch 228 is entirely formed before insertion of a textile article.
Figure 18:
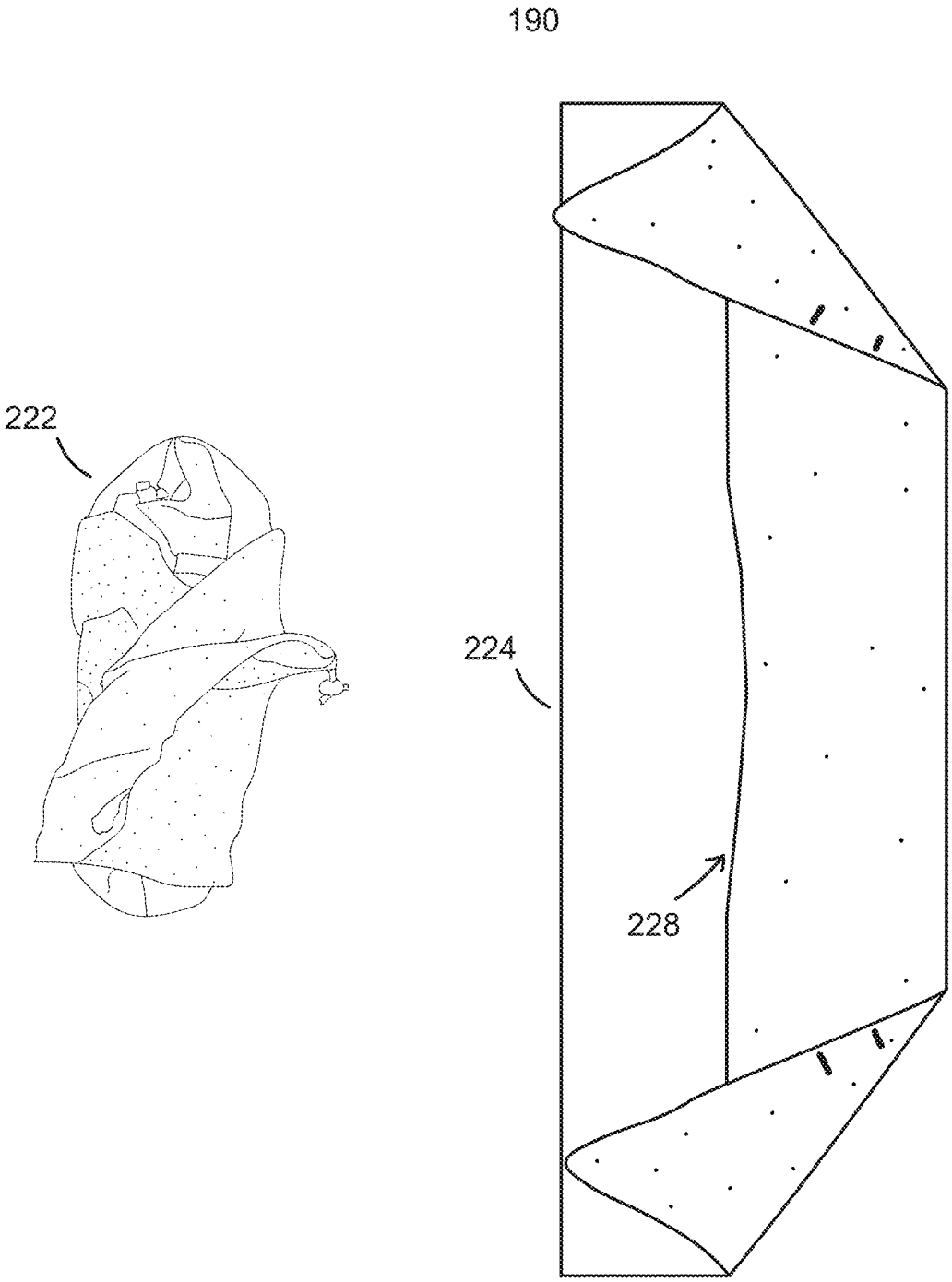
FIG. 18 illustrates the textile sheet 224 of FIG. 17 having been folded and tacked to create the virtual pouch 228, and a textile article 222 for insertion into the virtual pouch 228.
Figure 19:
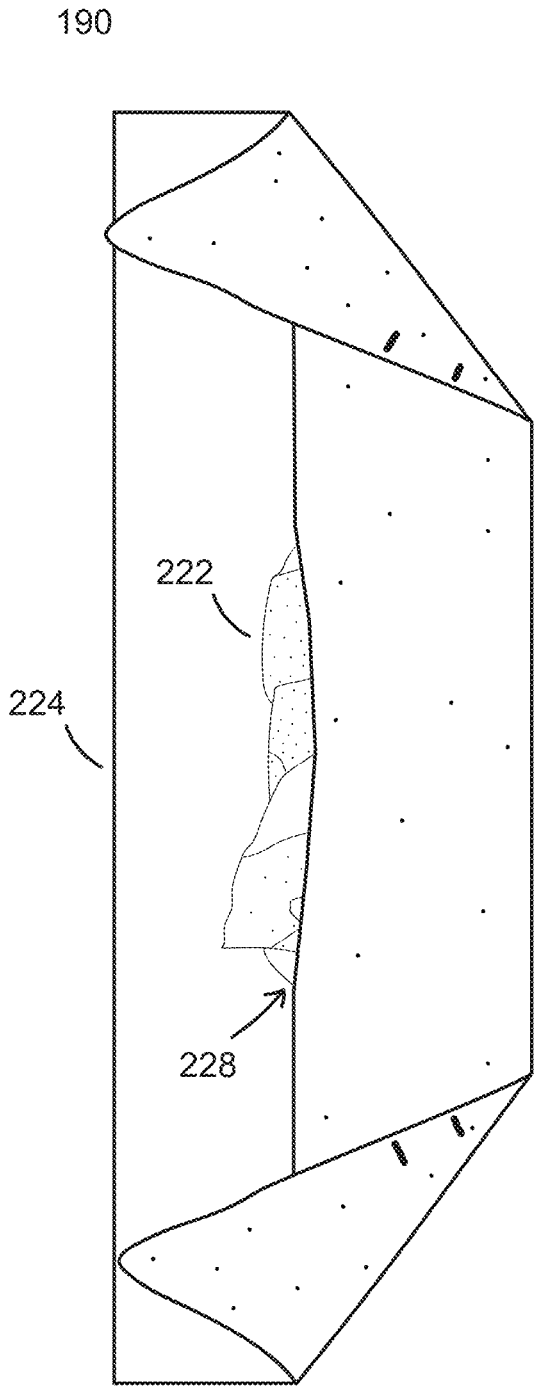
FIG. 19 illustrates the textile article 222 having been inserted into or otherwise located in the virtual pouch 228 of FIG. 18.

FIG. 17 illustrates tacking at locations 221,223 of a textile sheet 224 that is being used as the first sheet in another embodiment in accordance with one or more aspects and features of the invention, wherein a virtual pouch 228 is entirely formed before insertion of a textile article. The tacking at 221,223 represents, for example, single-point stitching, welding, or gluing. FIG. 18 illustrates the textile sheet 224 of FIG. 17 having been folded and tacked to create the virtual pouch 228, and also illustrates a textile article 222 for insertion into the virtual pouch 228. FIG. 19 illustrates the textile article 222 subsequently having been inserted into the virtual pouch 228.

Figure 20:
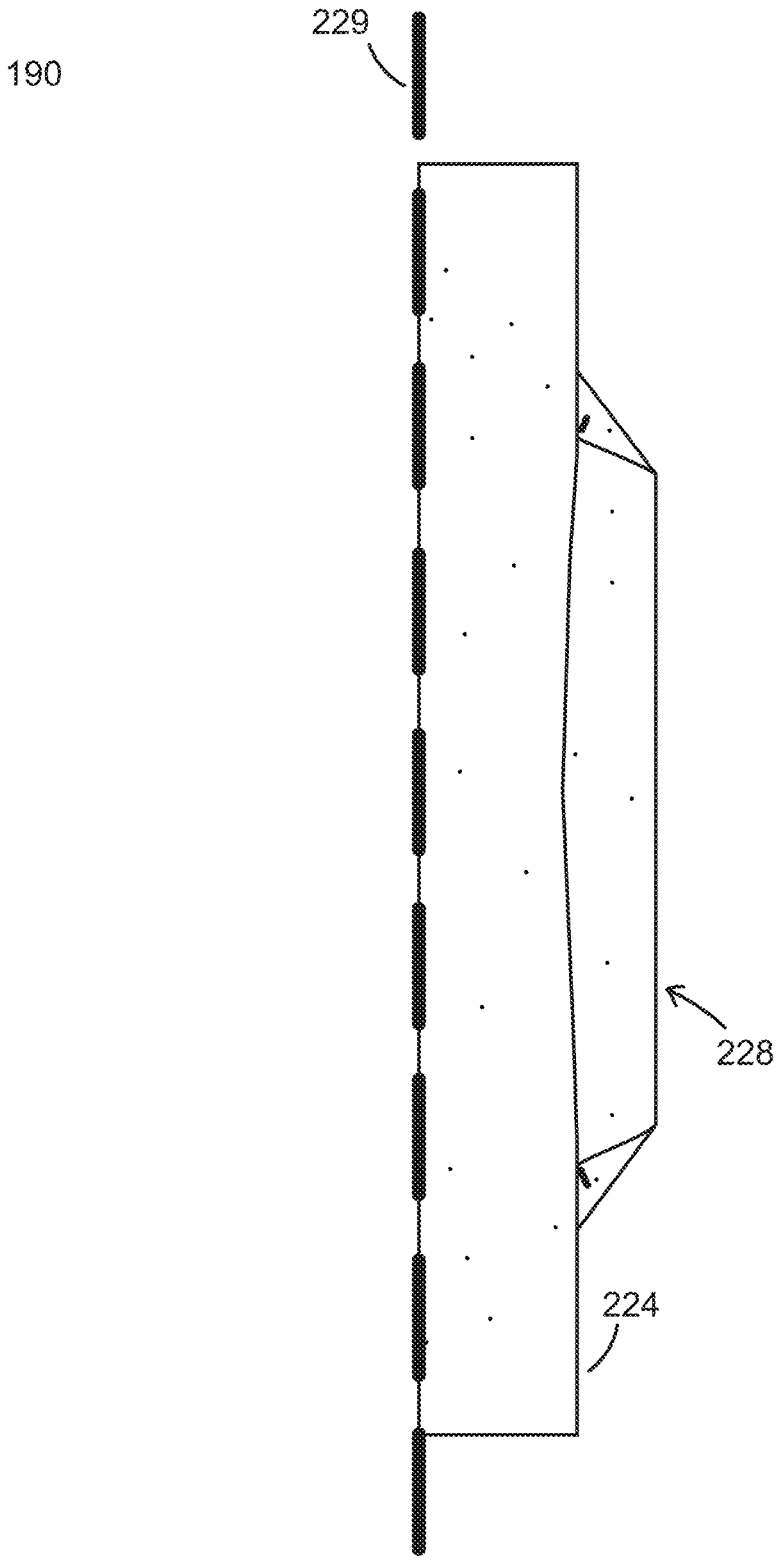
FIG. 20 illustrates a further fold in the textile sheet 224 about fold line 229 for closing the virtual pouch 228 and encompassing the textile article 222 received in the virtual pouch 228.

To complete the packaging of the textile article located in the virtual pouch of the first textile sheet—which represents the first phase of the packaging methods and processes, a further fold in the textile sheet 224 about fold line 229 is made in order to close off the opening of the virtual pouch 228 and encompass the textile article 222 having been received in the virtual pouch 228. This is illustrated in FIG. 20.

Figure 21:
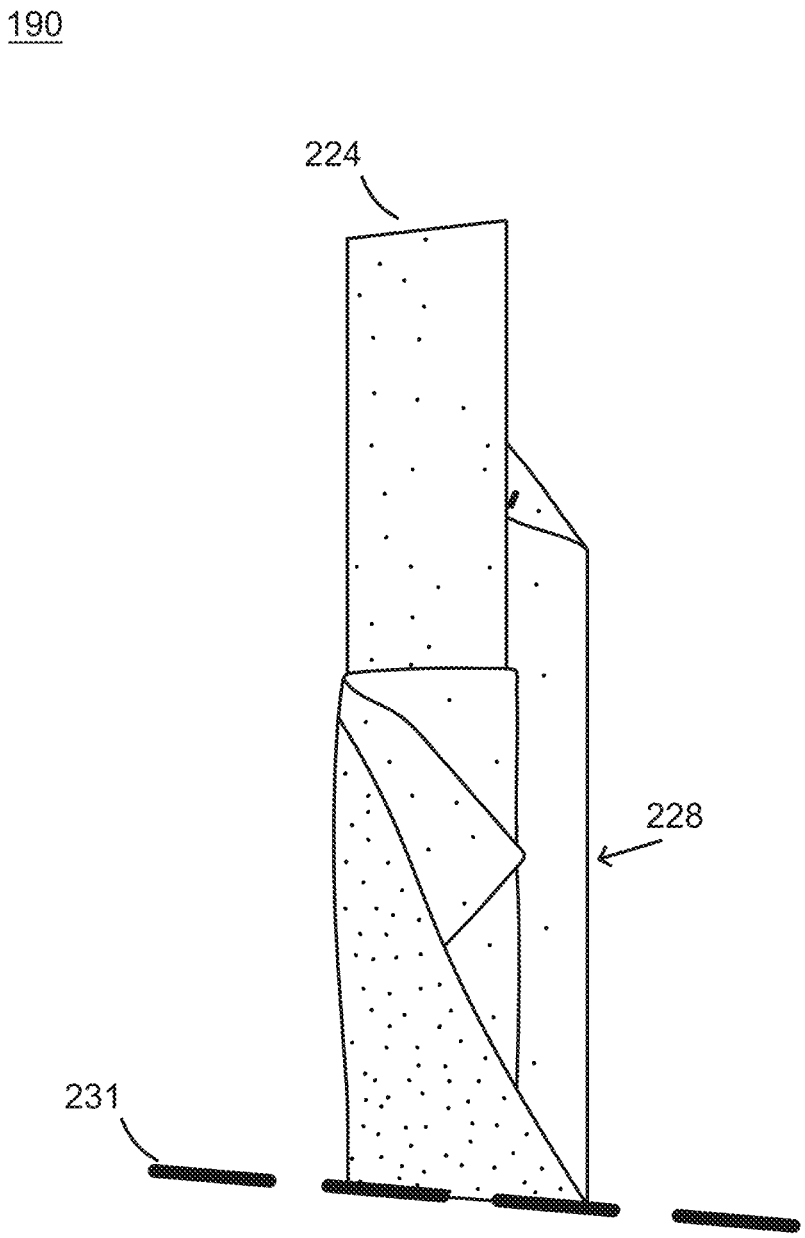
FIG. 21 illustrates a further fold in the textile sheet 224 about fold line 231.
Figure 22:
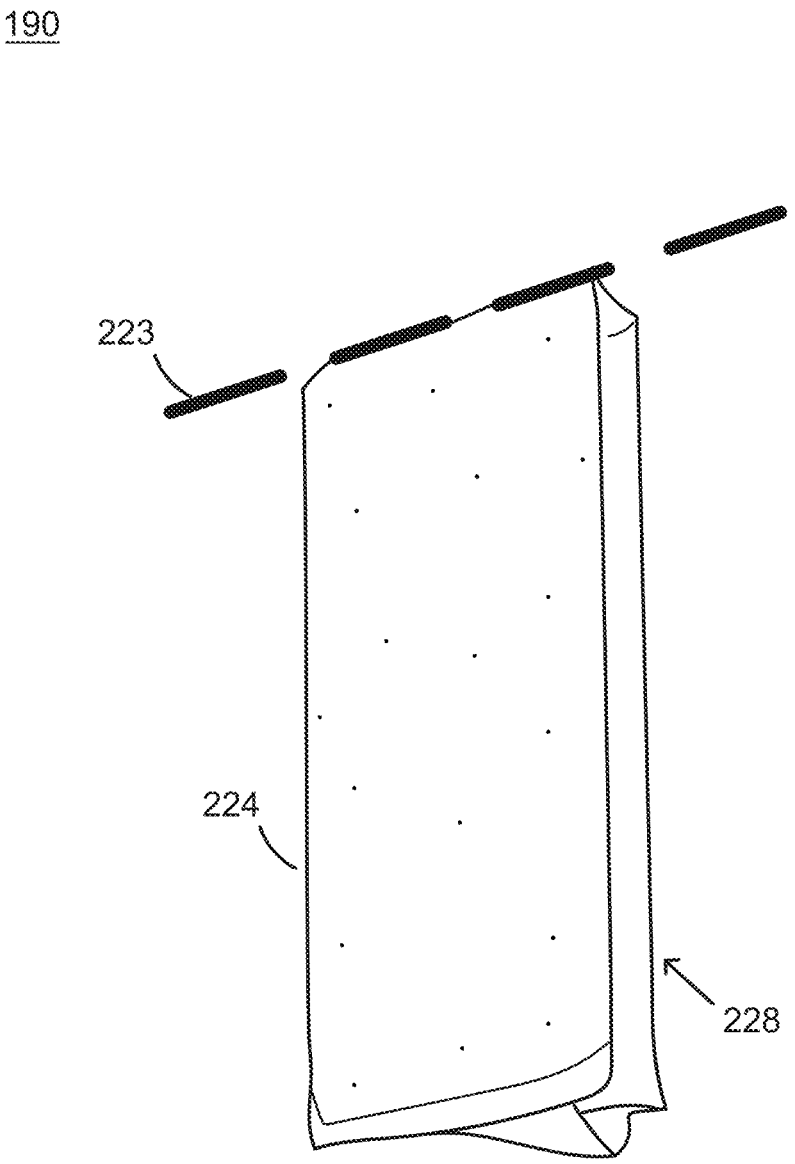
FIG. 22 illustrates a further fold in the textile sheet 224 about fold line 233.
Figure 23:
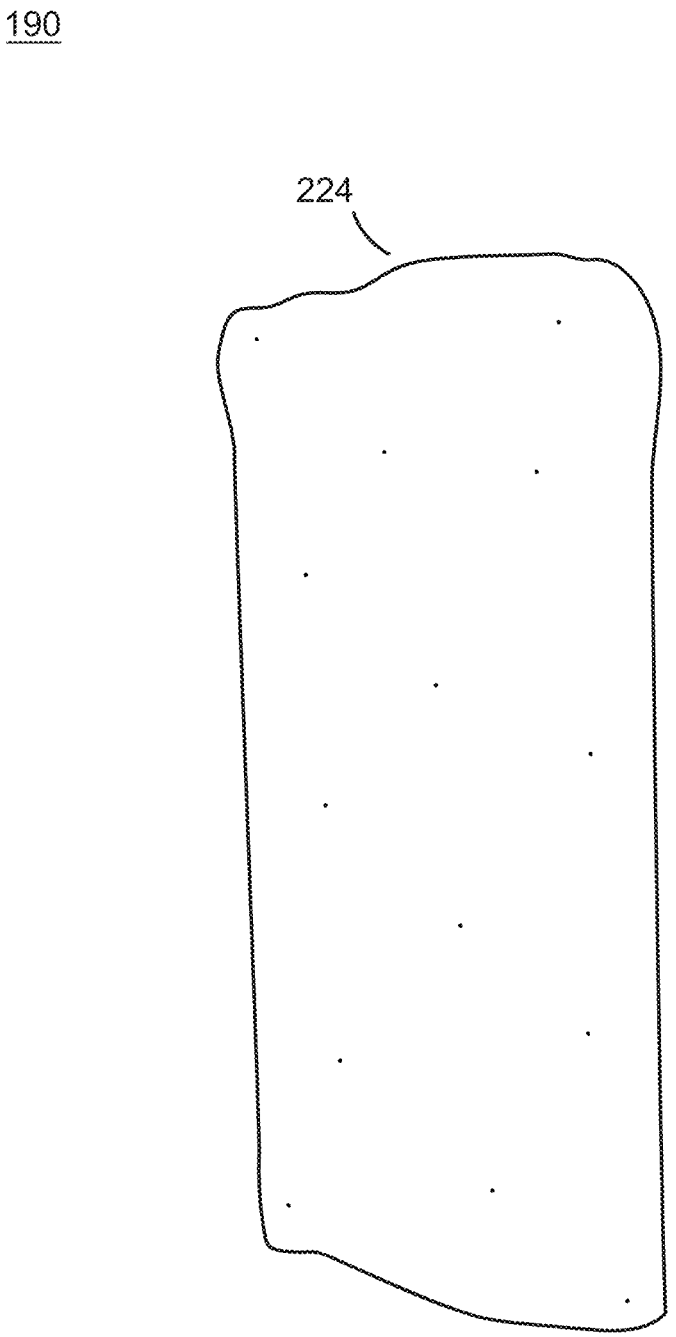
FIG. 23 illustrates a view of the folded textile sheet 224 of FIG. 22 in a direction that is opposite to the direction of view of FIG. 22, FIG. 23 showing the opposite side of the folded textile sheet 224 relative to that shown in FIG. 22.

The first sheet 224 then is further folded to secure the first sheet 224 in its configuration encompassing the textile article 222 contained in the virtual pouch 228. In this respect, FIG. 21 illustrates a further fold in the textile sheet 224 about fold line 231; FIG. 22 illustrates a further fold in the textile sheet 224 about fold line 233; and FIG. 23 illustrates a view of the folded textile sheet 224 of FIG. 22 in a direction that is opposite to the direction of view of FIG. 22, FIG. 23 showing the opposite side of the folded textile sheet 224 relative to that shown in FIG. 22. These preferred folding steps complete the first phase.

In the second phase, the intermediate package formed in the first phase, namely, the folded textile sheet encompassing the textile article, is itself subsequently packaged by wrapping it in an outer, second sheet of textile material and securing the resulting package. This second phase is illustrated in FIGS. 24-31.

Figure 24:
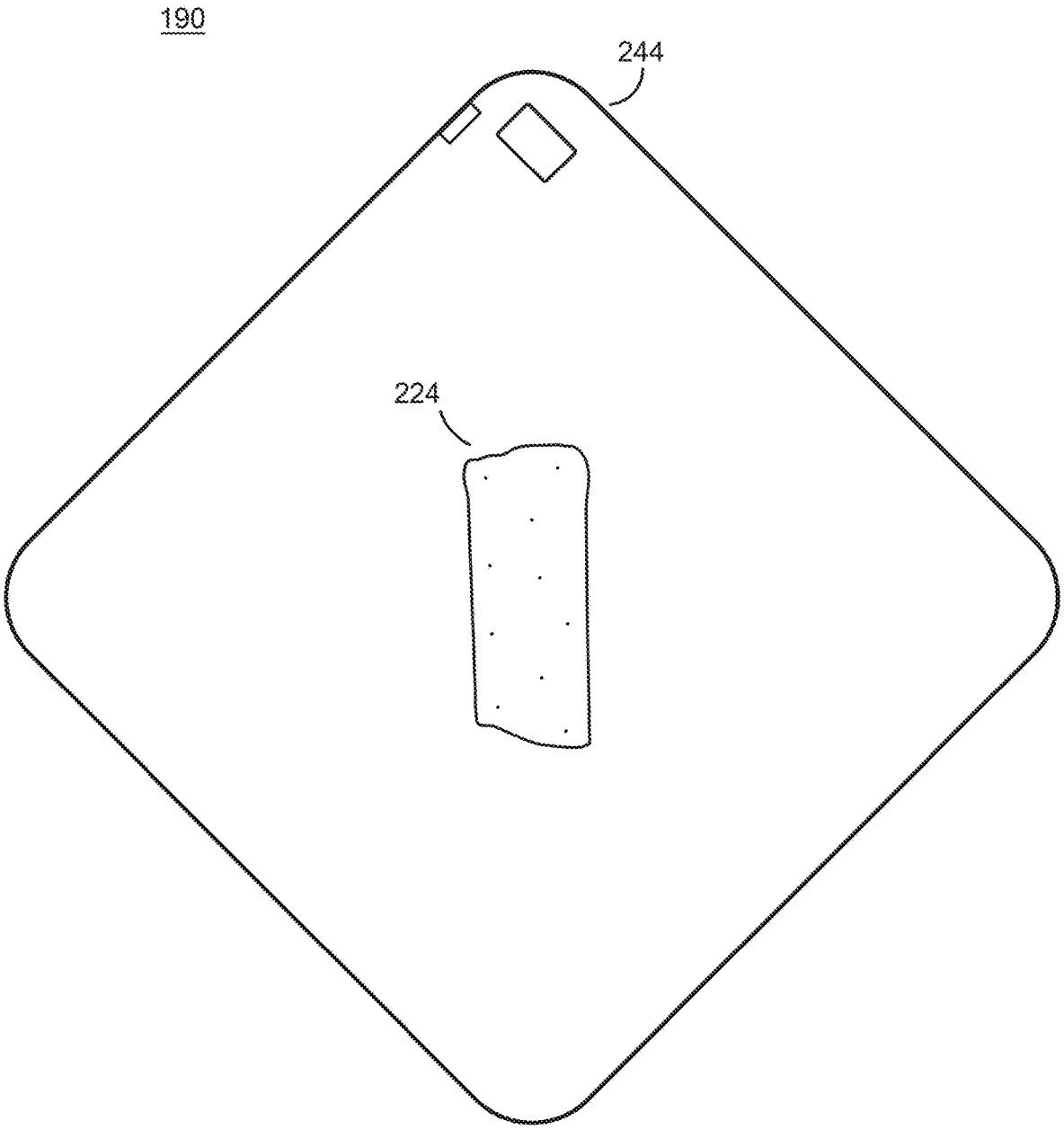
FIG. 24 illustrates the folded textile sheet 224 of FIG. 23 being placed on top of a second textile sheet 244 that has been laid generally flat on the surface 190.
Figure 25:
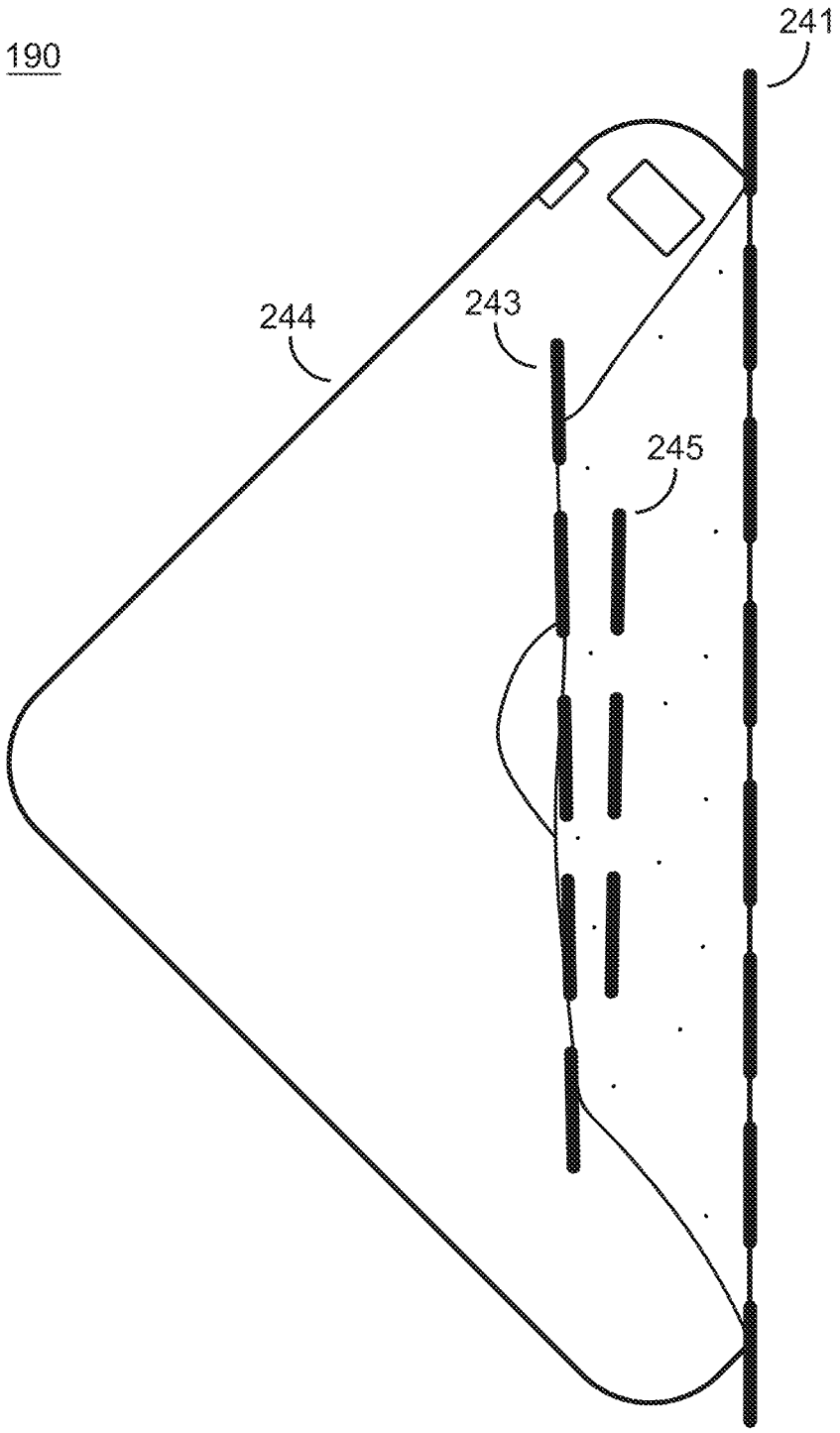
FIG. 25 illustrates the second textile sheet 244 having been folded about fold lines 241,243,245 for wrapping therein the first folded textile sheet 224.

In particular, FIG. 24 illustrates the folded first textile sheet 224 of FIG. 23, which encompasses the textile article 222, being placed on top of a second textile sheet 244 that has been laid generally flat on the surface 190. Next, FIG. 25 illustrates the second textile sheet 244 having been folded about fold lines 241,243,245 for wrapping therein the first folded textile sheet 224. Note that the second textile sheet 244 may be folded about fold line 243,245 by tucking the corner of the second textile sheet 244 behind the folded first textile sheet 224 with the corner of the second textile sheet 244 being turned up, as shown in FIG. 25.

Figure 26:
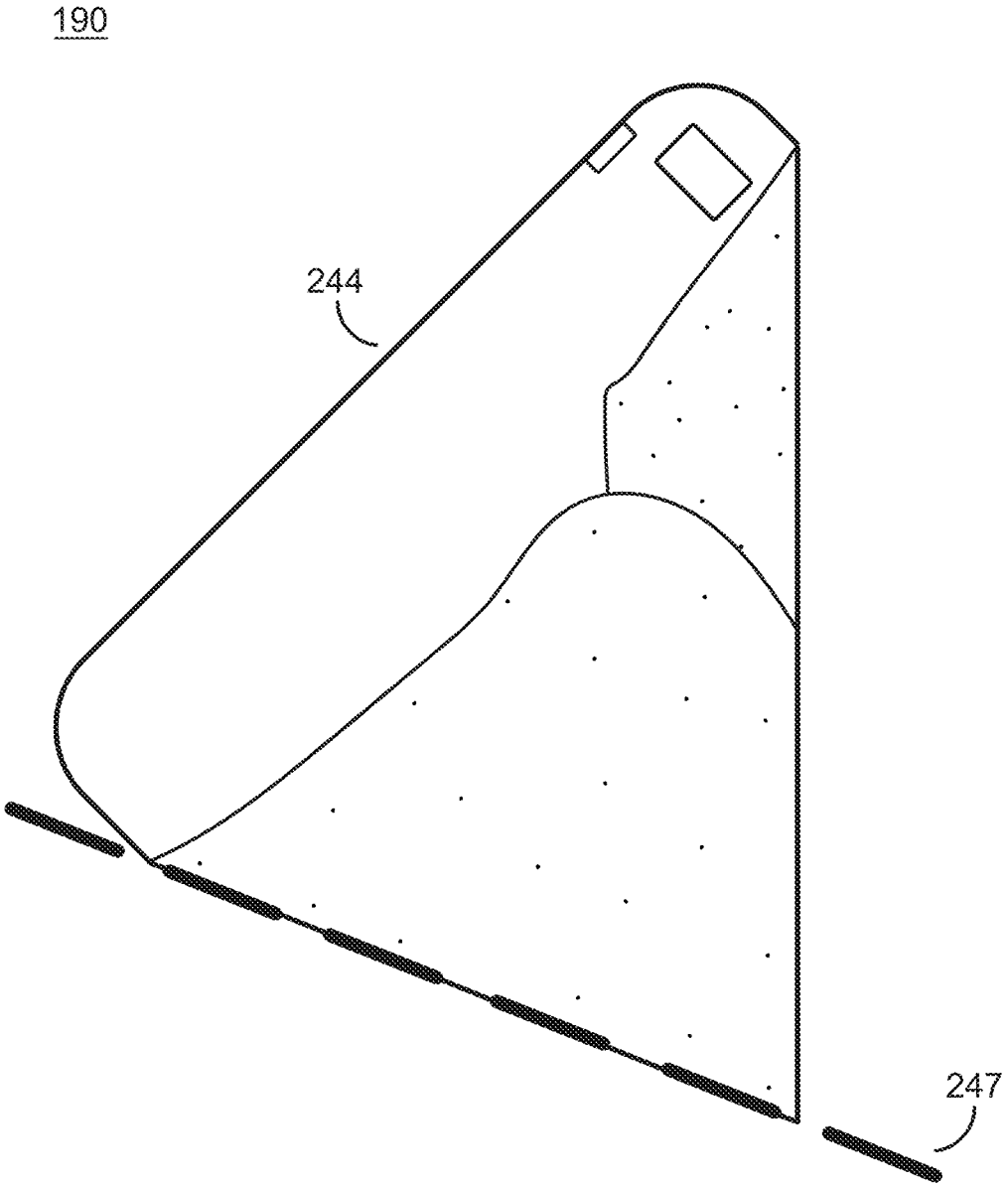
FIG. 26 illustrates the folded second textile sheet 244 having been further folded about fold line 247 for wrapping therein the first folded textile sheet 224.
Figure 27:
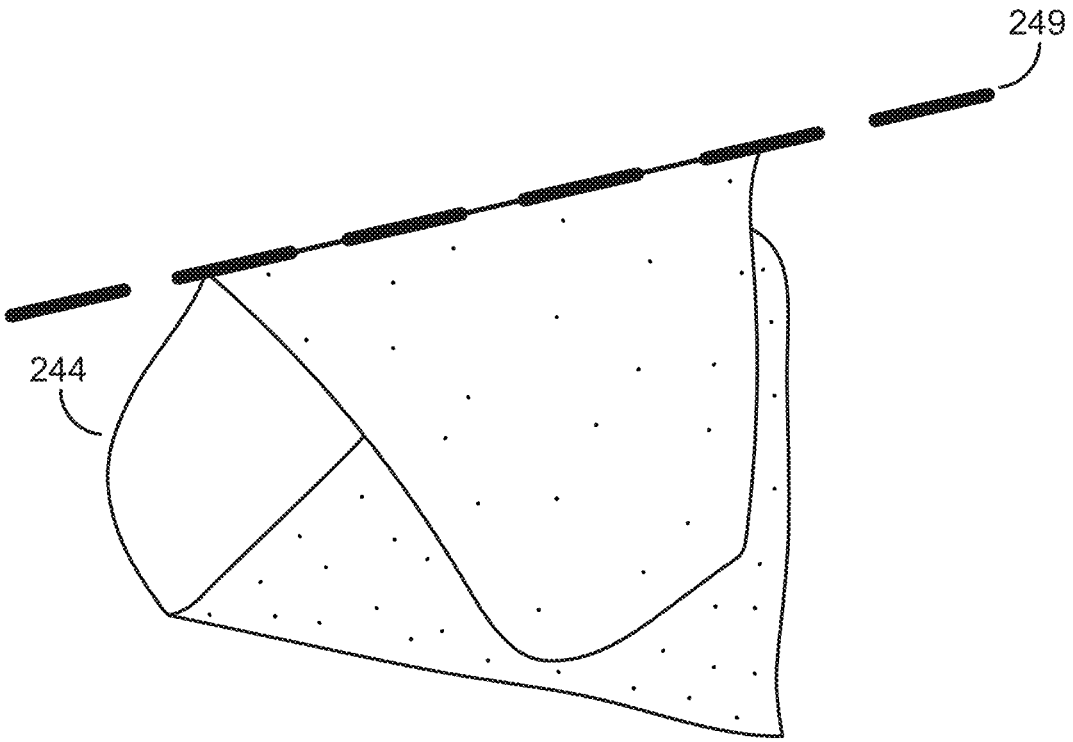
FIG. 27 illustrates the folded second textile sheet 244 having been further folded about fold line 249 for wrapping therein the first folded textile sheet 224.

Next, FIG. 26 illustrates the folded second textile sheet 244 having been further folded about fold line 247 for wrapping therein the first folded textile sheet 224. Next, FIG. 27 illustrates the folded second textile sheet 244 having been further folded about fold line 249 for wrapping therein the first folded textile sheet 224. Finally, FIG. 28 illustrates the folded second textile sheet 244 having been further folded about fold lines 251,253,255 for completing the wrapping therein of the first folded textile sheet 224.

Figure 28:
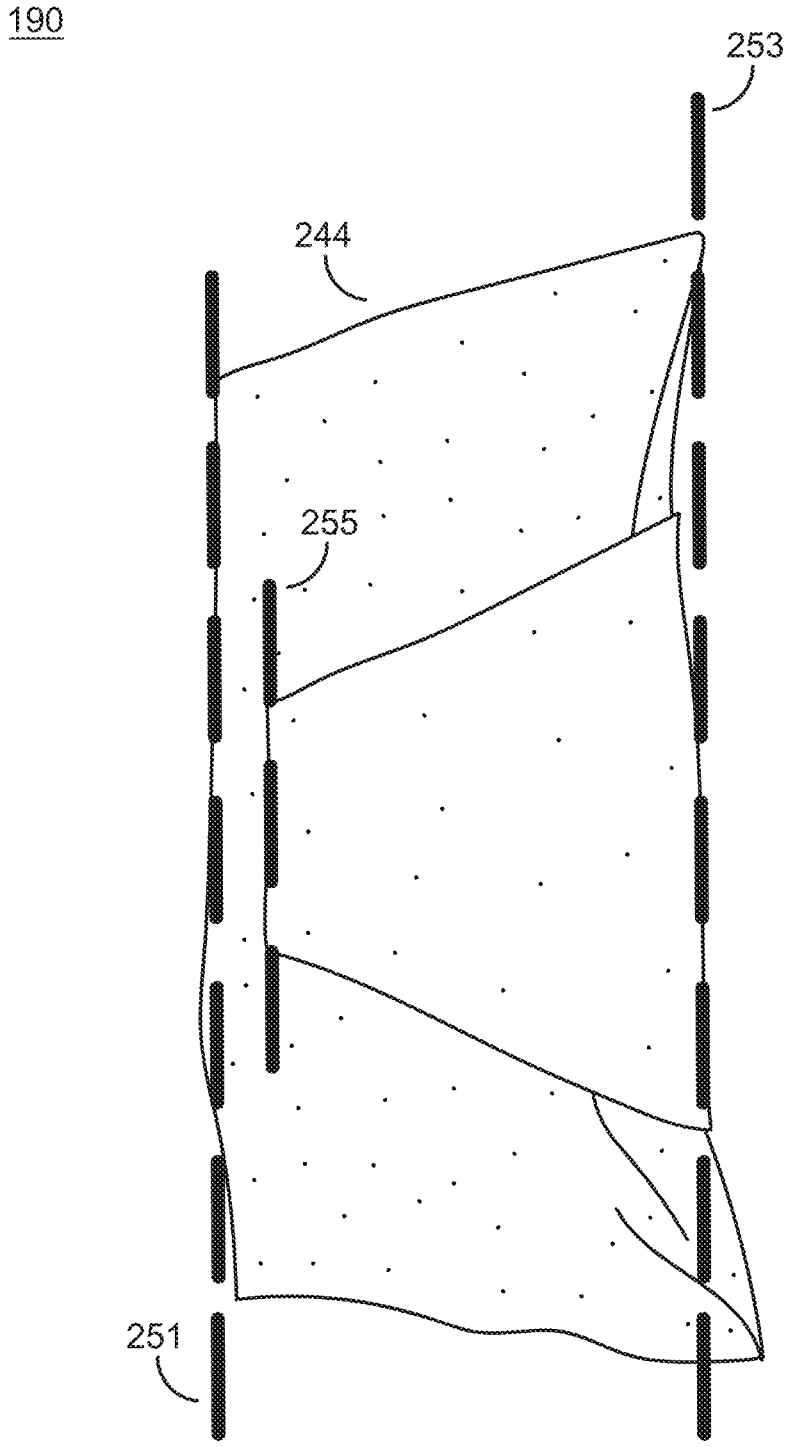
FIG. 28 illustrates the folded second textile sheet 244 having been further folded about fold lines 251,253,255 for wrapping therein the first folded textile sheet 224.
Figure 29:
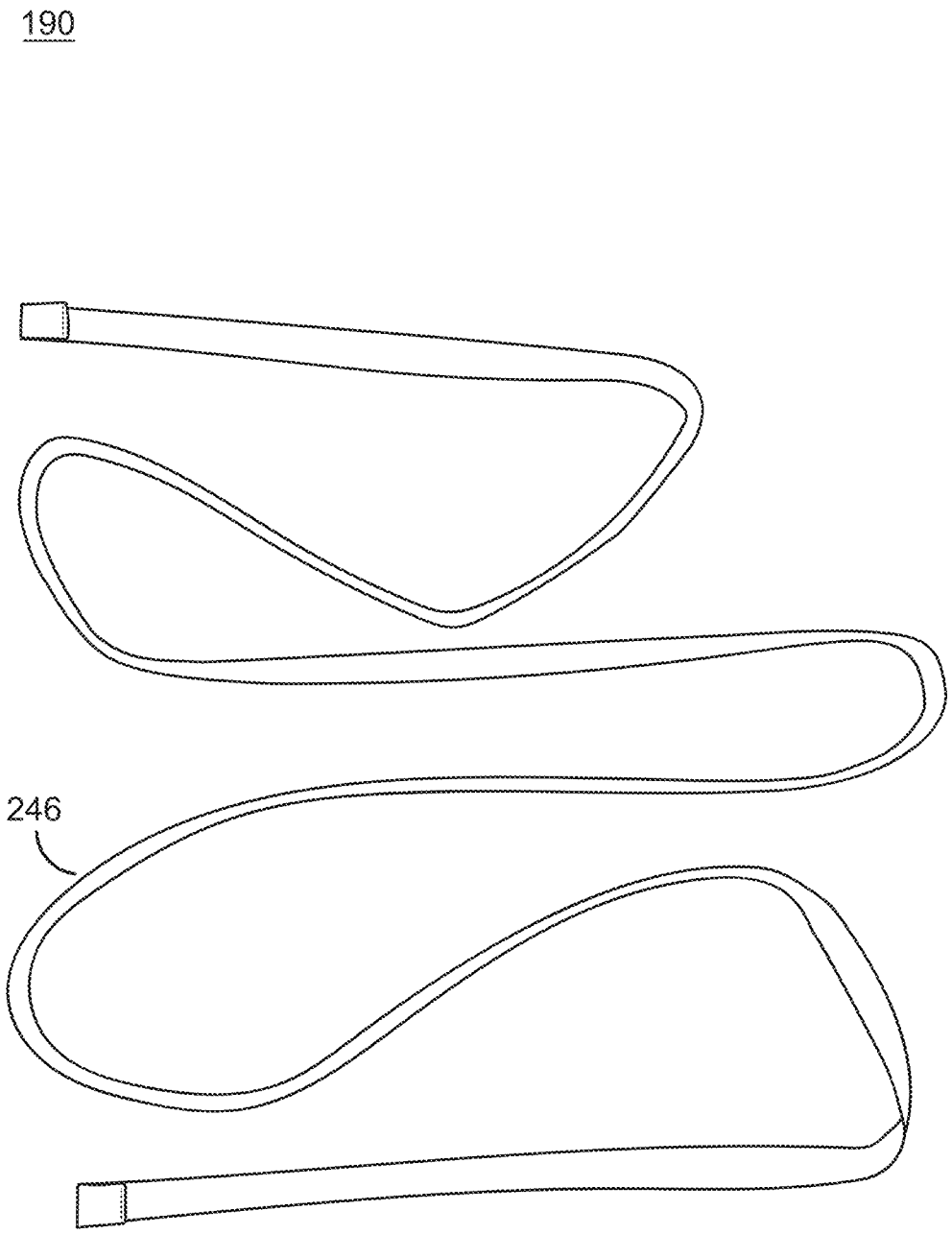
FIG. 29 illustrates a strap 246 for securing the second folded textile sheet 224 in its folded configuration shown in FIG. 28.
Figure 30:
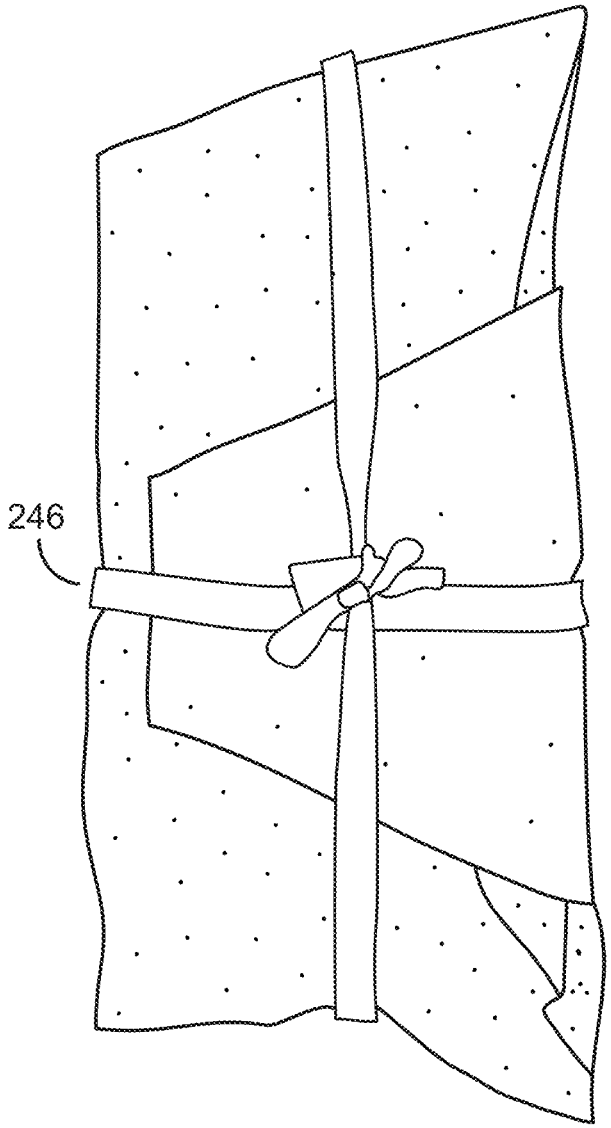
FIG. 30 illustrates a top view of the folded second textile sheet 224 secured in its folded configuration of FIG. 28 by the strap 246 of FIG. 29.
Figure 31:
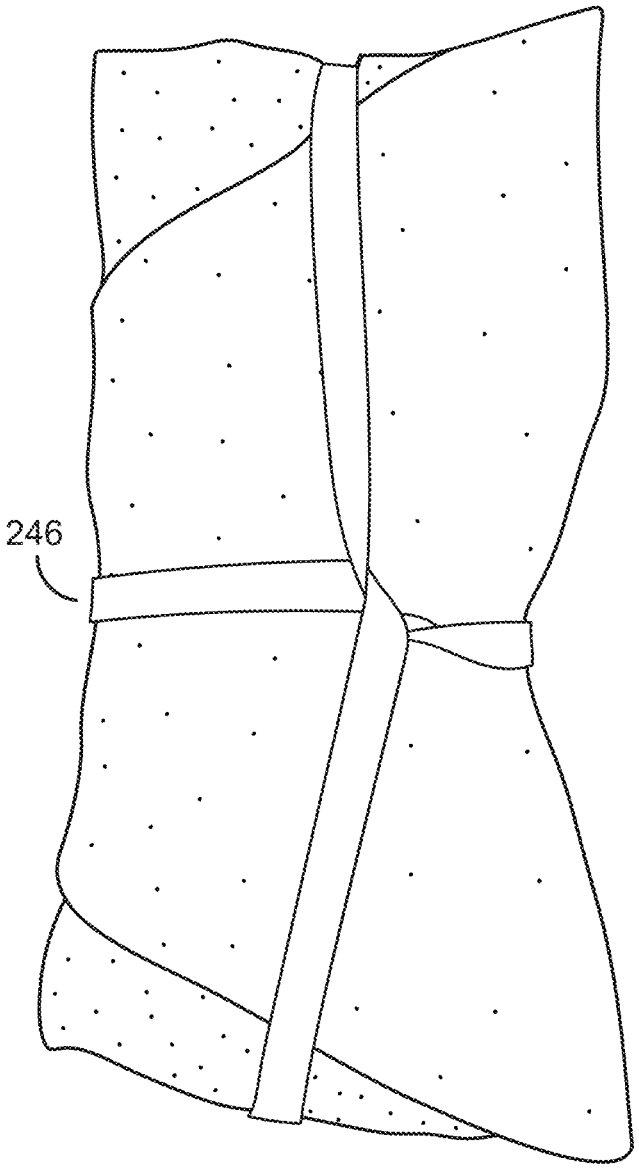
FIG. 31 illustrates a bottom view of the folded second textile sheet 224 secured in its folded configuration shown in FIG. 30.

To secure the resulting packaging of FIG. 28, FIG. 29 illustrates a strap 246 for securing the second folded textile sheet 224 in its folded configuration as shown in FIG. 28. FIG. 30 illustrates a top view of the folded second textile sheet 224 secured in its folded configuration of FIG. 28 by the strap 246 of FIG. 29; and FIG. 31 illustrates a bottom view of the folded second textile sheet 224 secured in its folded configuration shown in FIG. 30. As shown in FIG. 31, the strap is twisted about itself to extend in orthogonal directions, whereby the strap bounds all four sides of the resulting package from the folding of FIGS. 25-28.

Alternative Tacking Configurations

Figure 32:
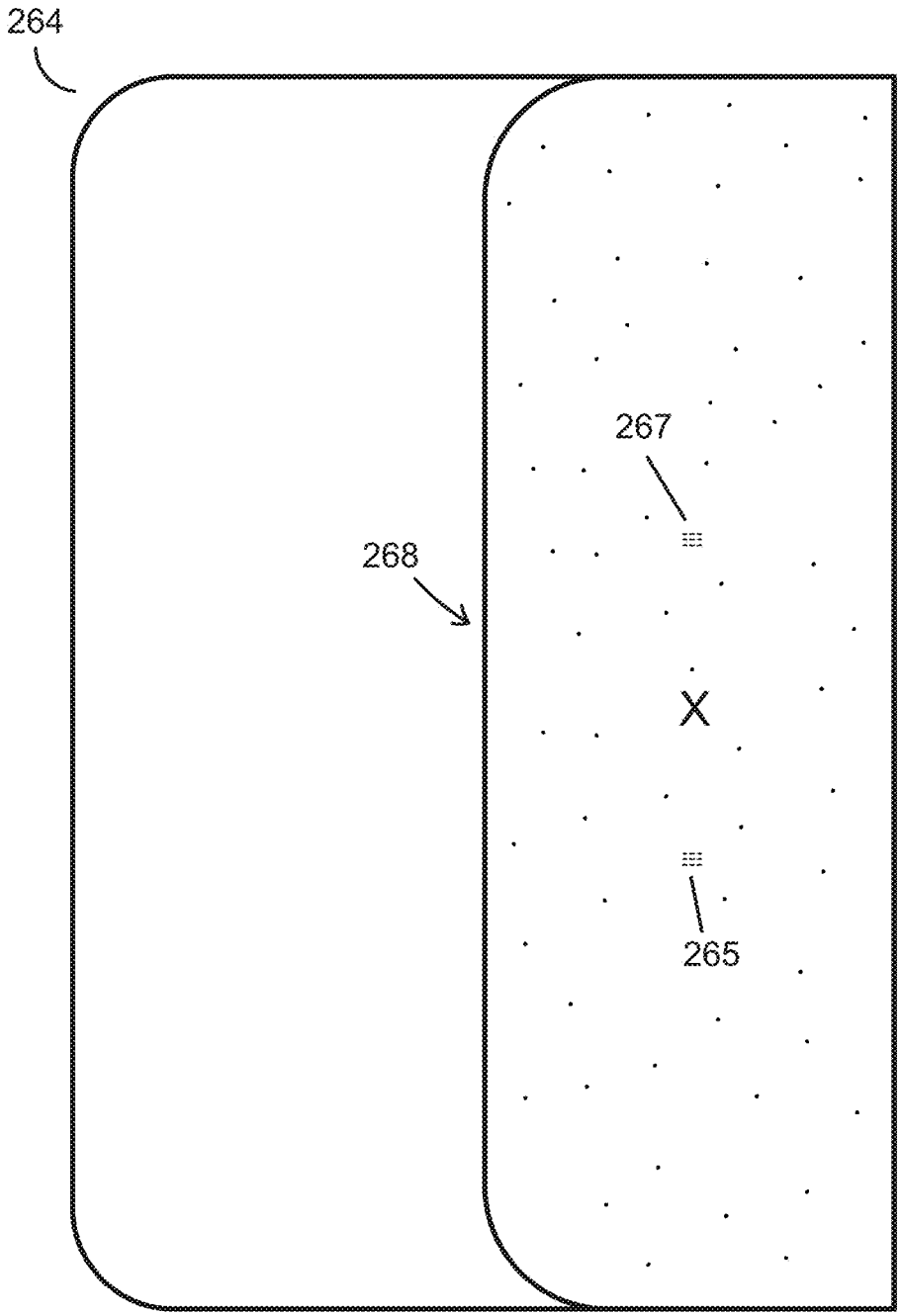
FIG. 32 illustrates an embodiment of a textile sheet 264 folded and tacked once on opposite sides (indicated by callouts 265,267) of the area (indicated generally by X) for forming a virtual pouch 268 in accordance with one or more aspects and features of the invention.

In creating the virtual pouch, there are a number of ways to tack the first textile sheet. A first way illustrated in FIG. 32 is representative of the tacking shown in FIG. 17. Specifically, FIG. 32 illustrates an embodiment of a textile sheet 264 folded and tacked once on opposite sides (indicated by callouts 265,267) of the area (indicated generally by X) for forming a virtual pouch 268 in accordance with one or more aspects and features of the invention.

Figure 33:
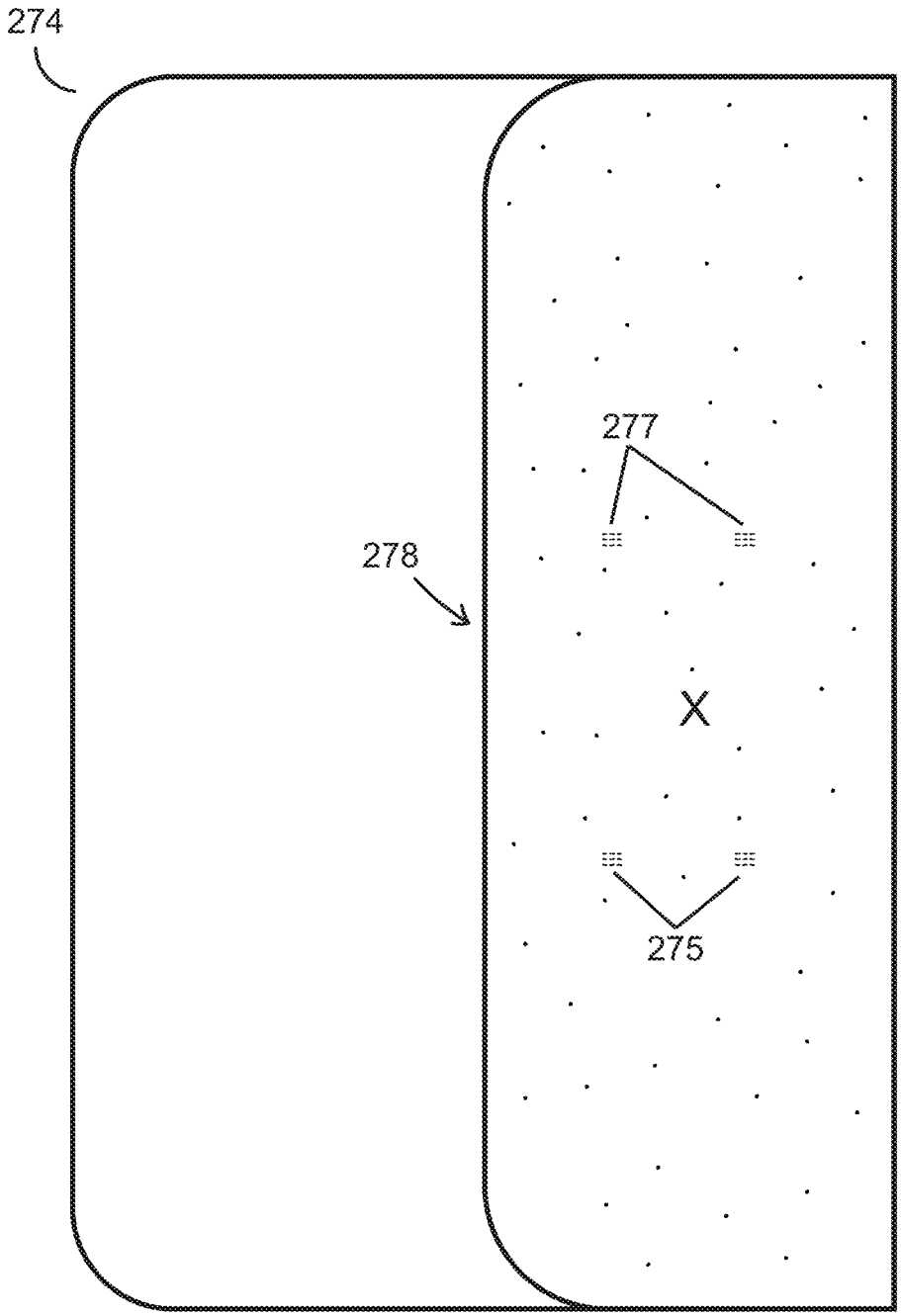
FIG. 33 illustrates an embodiment of a textile sheet 274 folded and tacked twice on opposite sides (indicated by callouts 275,277) of the area (indicated generally by X) for forming a virtual pouch 278 in accordance with one or more aspects and features of the invention.

FIG. 33 illustrates an alternative tacking. Specifically, FIG. 33 illustrates an embodiment of a textile sheet 274 folded and tacked twice on opposite sides (indicated by callouts 275,277) of the area (indicated generally by X) for forming a virtual pouch 278 in accordance with one or more aspects and features of the invention.

Figure 34:
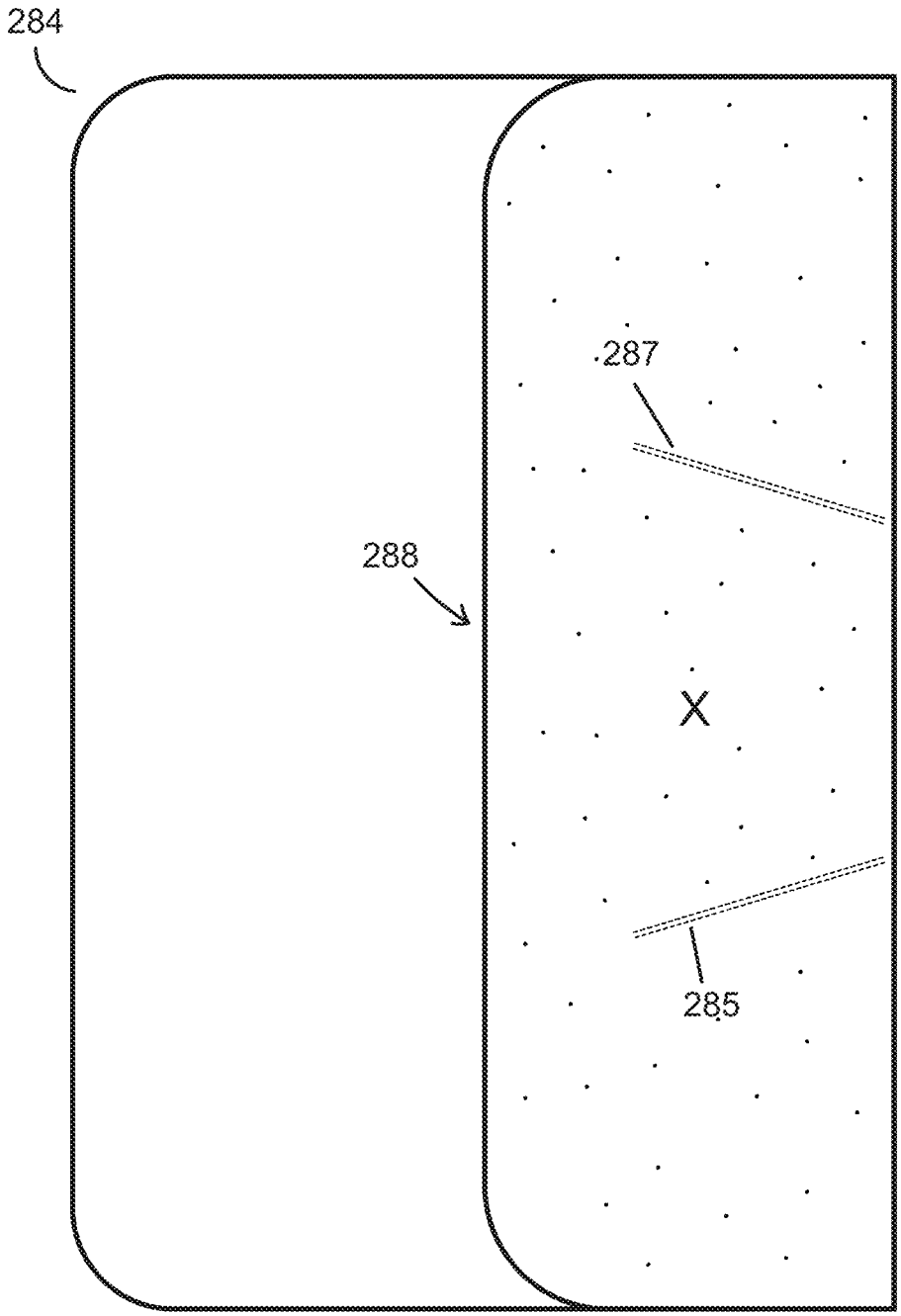
FIG. 34 illustrates an embodiment of a textile sheet 284 folded and secured in a continuous line of tacking on opposite sides (indicated by callouts 285,287) of the area (indicated generally by X) for forming a virtual pouch 288 in accordance with one or more aspects and features of the invention.

FIG. 34 illustrates an alternative tacking. Specifically, FIG. 34 illustrates an embodiment of a textile sheet 284 folded and secured in a continuous line of tacking on opposite sides (indicated by callouts 285,287) of the area (indicated generally by X) for forming a virtual pouch 288 in accordance with one or more aspects and features of the invention.

Figure 35:
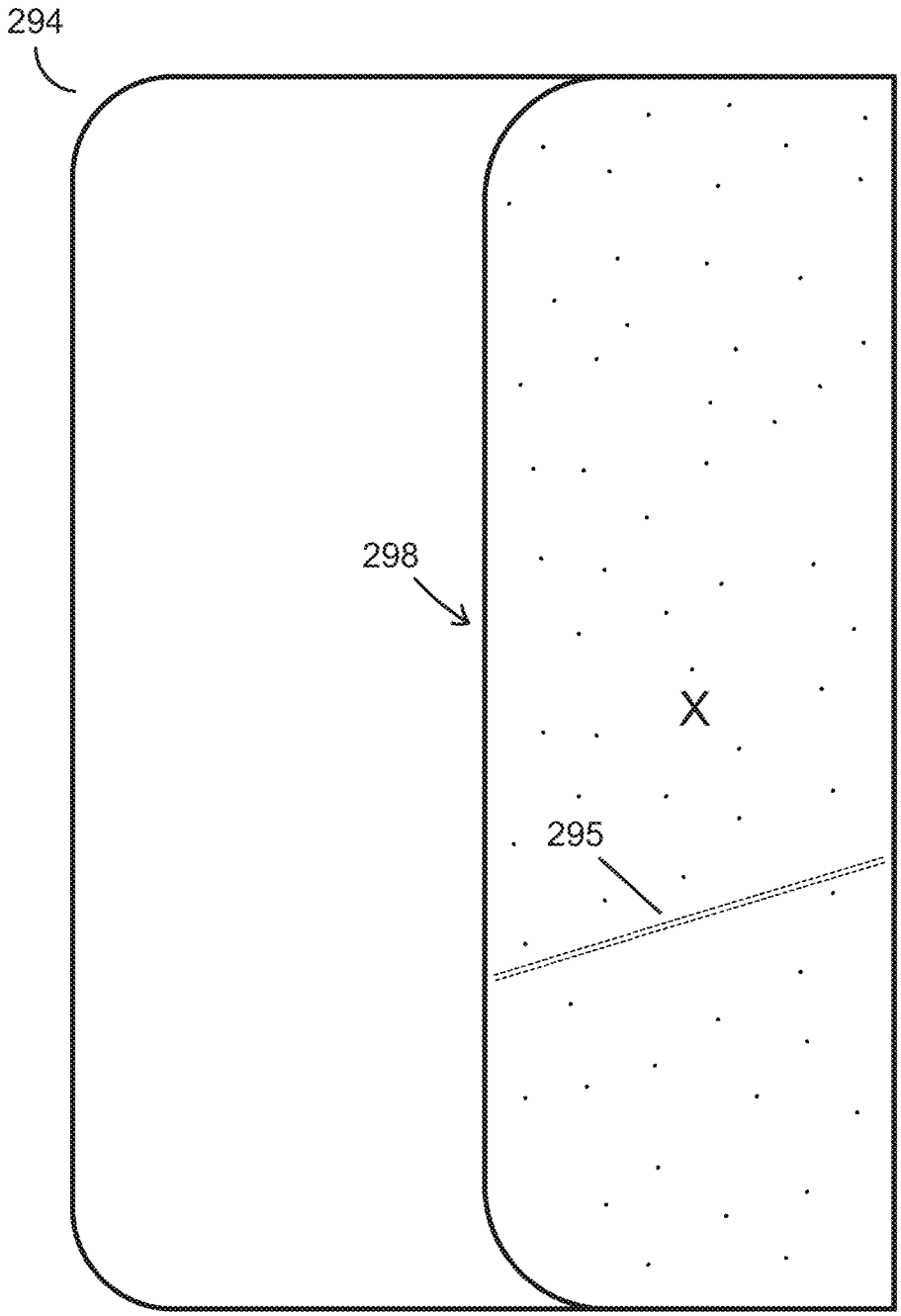
FIG. 35 illustrates an embodiment of a textile sheet 294 folded and secured in a continuous line of tacking on a single side (indicated by callout 295) of the area (indicated generally by X) for forming a virtual pouch 298 in accordance with one or more aspects and features of the invention.

FIG. 35 illustrates an alternative tacking. Specifically, FIG. 35 illustrates an embodiment of a textile sheet 294 folded and secured in a continuous line of tacking on a single side (indicated by callout 295) of the area (indicated generally by X) for forming a virtual pouch 298 in accordance with one or more aspects and features of the invention.

Figure 36:
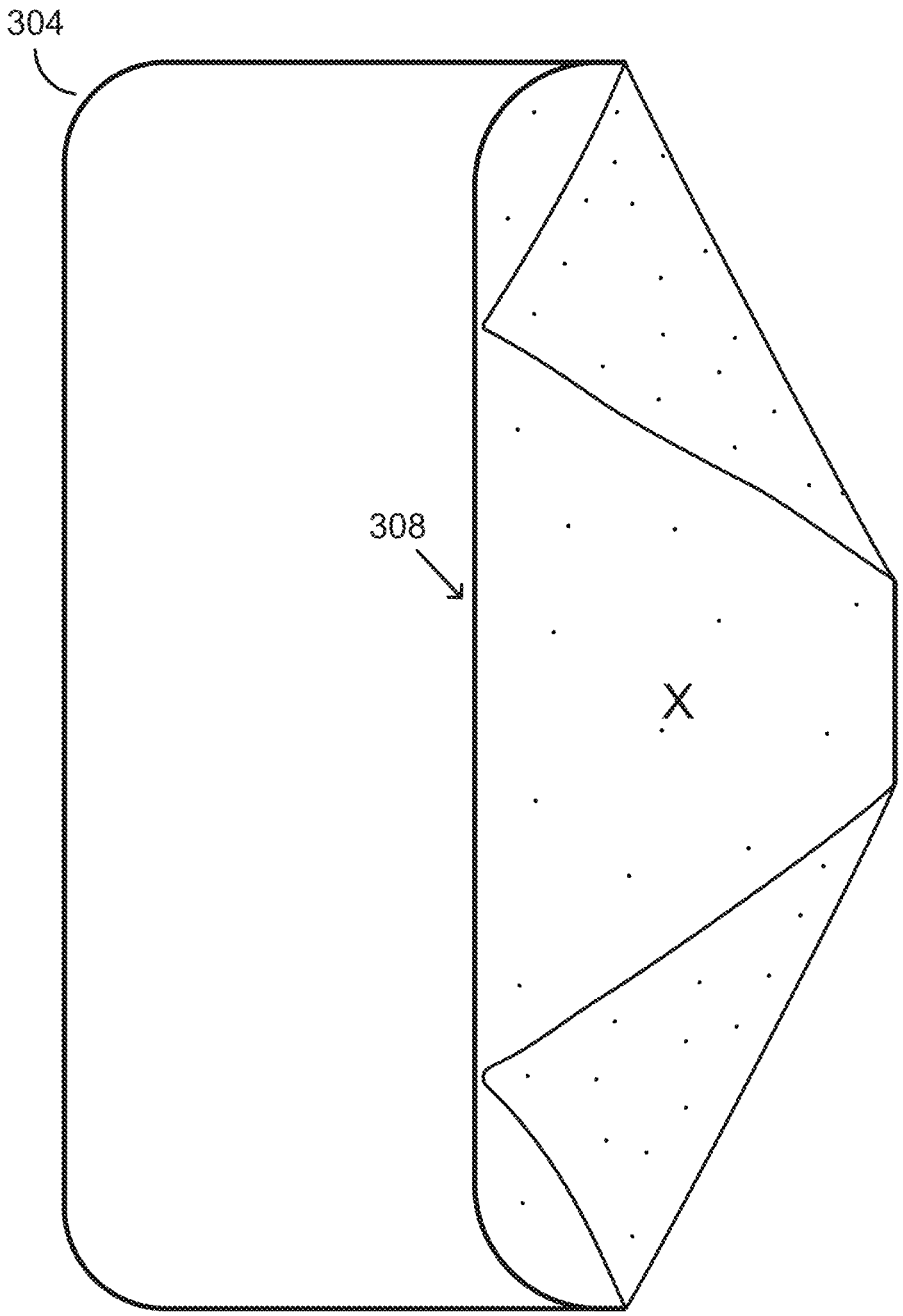
FIG. 36 illustrates an embodiment of a textile sheet 304 folded three times in creating a virtual pouch 308.

The tacking in FIGS. 32-35 is of the first textile sheet in a single-fold configuration. The first textile sheet also may define a virtual pouch in a three-fold configuration that is shown in FIG. 36. Specifically, FIG. 36 illustrates an embodiment of a textile sheet 304 folded three times to define a virtual pouch 308.

Figure 37:
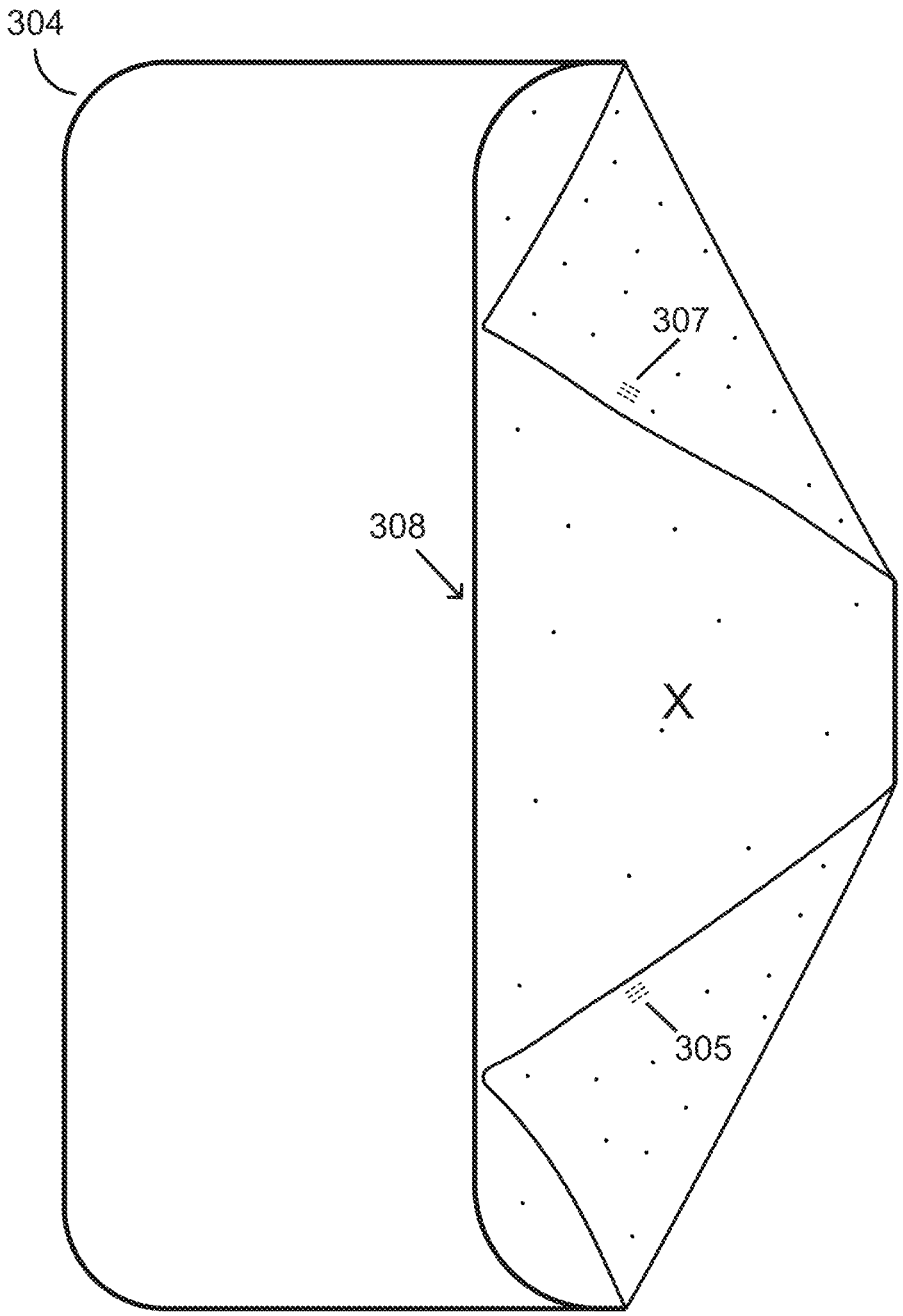
FIG. 37 illustrates the embodiment of FIG. 36 in which the folded textile sheet 304 includes single-point tacking on opposite sides 305,307 of the area (indicated generally by X) for at least temporarily securing the configuration defining the virtual pouch 308.

FIG. 37 illustrates a tacking for the folded sheet 304 of FIG. 36. Specifically, in FIG. 37 the folded textile sheet 304 includes single-point tacking on opposite sides 305,307 of the area (indicated generally by X) for securing the configuration defining the virtual pouch 308.

Figure 38:
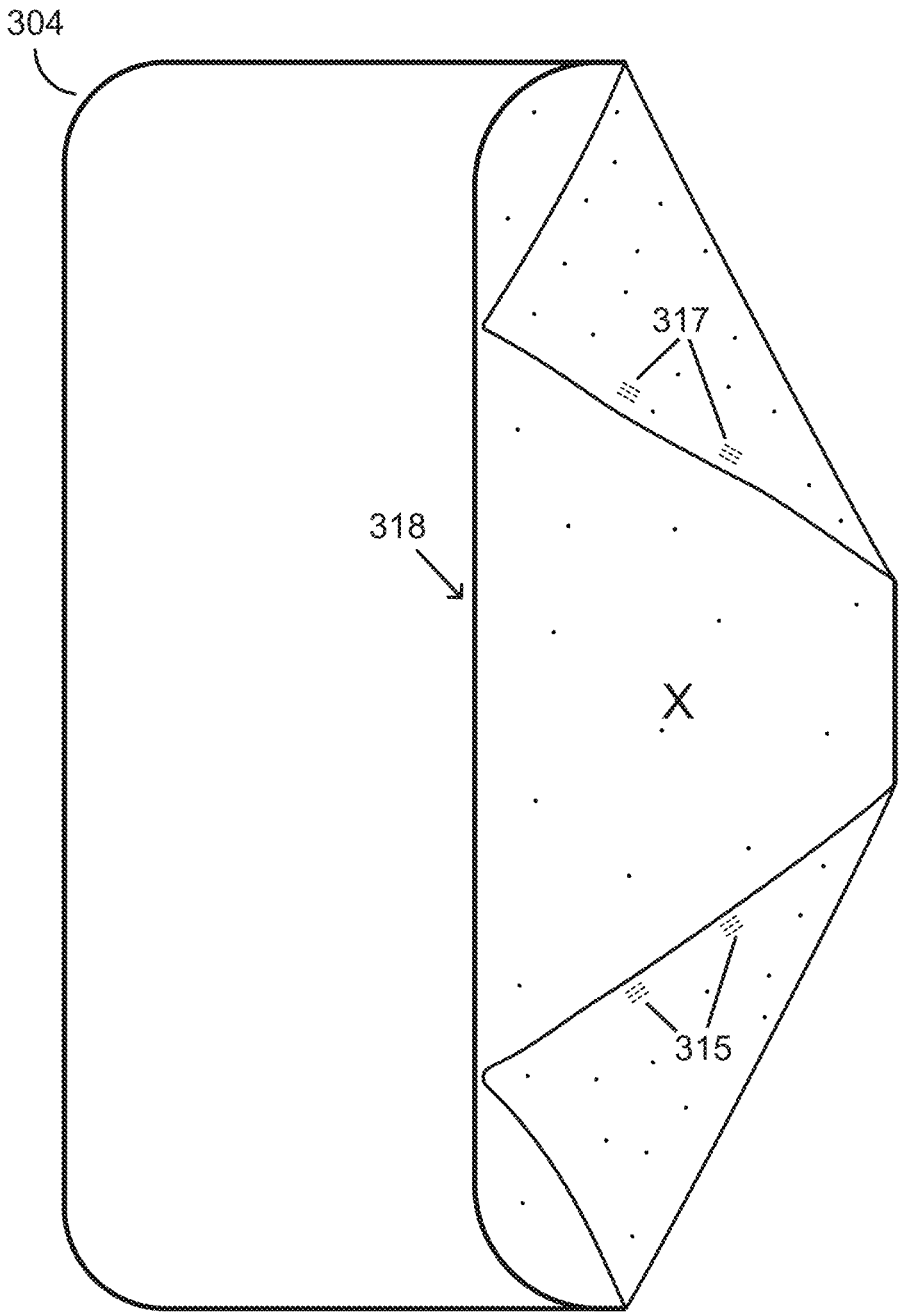
FIG. 38 illustrates the embodiment of FIG. 36 in which the folded textile sheet 304 includes double-point tacking on opposite sides 315,317 of the area (indicated generally by X) for at least temporarily securing the configuration defining the virtual pouch 318.

FIG. 38 illustrates an alternative tacking of the embodiment of FIG. 36. Specifically, in FIG. 38 the folded textile sheet 304 includes double-point tacking on opposite sides 315,317 of the area (indicated generally by X) for securing the configuration defining the virtual pouch 318.

Figure 39:
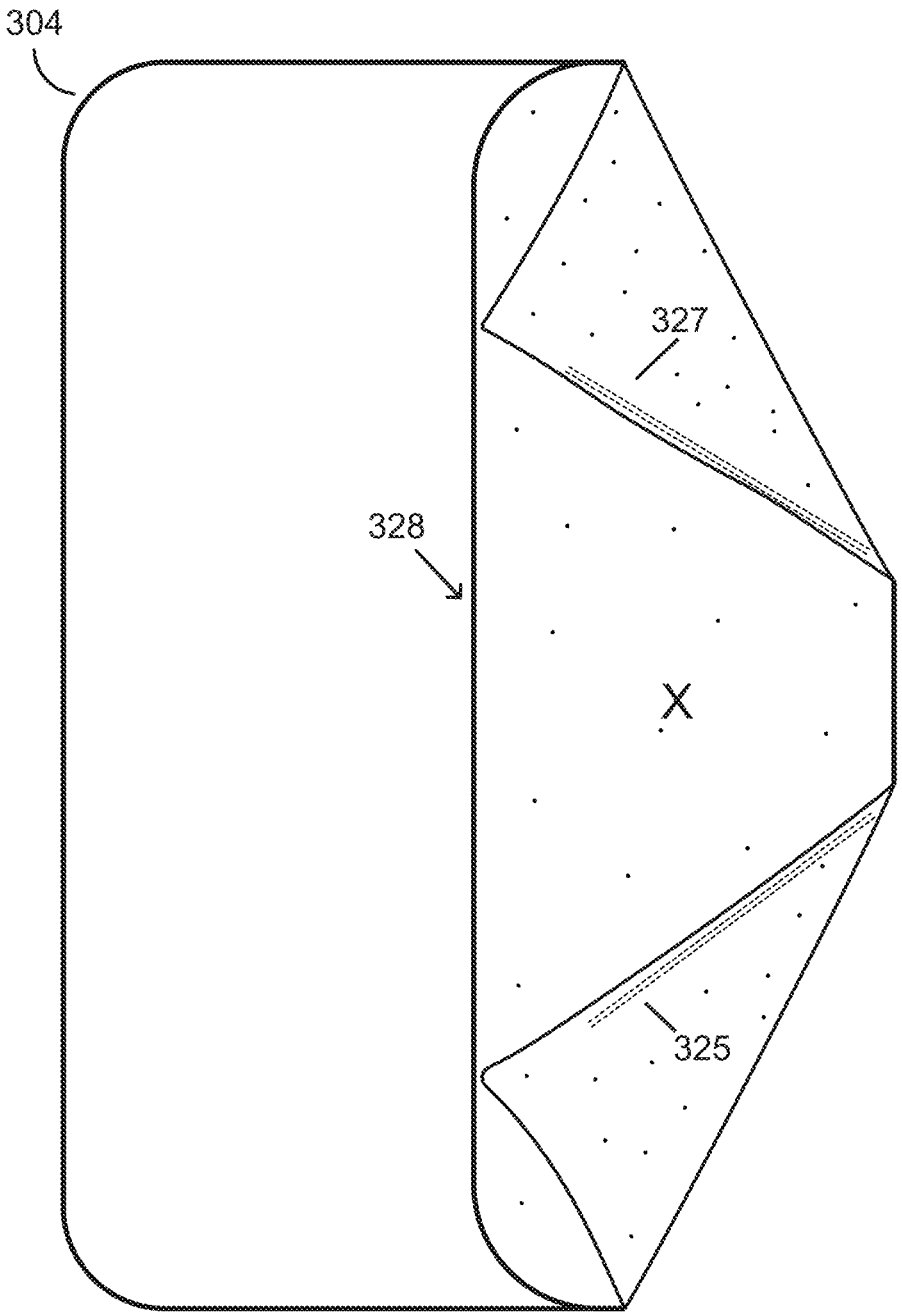
FIG. 39 illustrates the embodiment of FIG. 36 in which the folded textile sheet 304 includes a continuous line of tacking on opposite sides 325,327 of the area (indicated generally by X) for at least temporarily securing the configuration defining the virtual pouch 328.

FIG. 39 illustrates an alternative tacking of the embodiment of FIG. 36. Specifically, in FIG. 39 the folded textile sheet 304 includes a continuous line of tacking on opposite sides 325,327 of the area (indicated generally by X) for securing the configuration defining the virtual pouch 328.

Based on the foregoing description, it will be readily understood by those persons skilled in the art that the invention has broad utility and application. Many embodiments and adaptations of the invention other than those specifically described herein, as well as many variations, modifications, and equivalent arrangements, will be apparent from or reasonably suggested by the invention and the foregoing descriptions thereof, without departing from the substance or scope of the invention.

For example, it is contemplated that a textile article may first be wrapped in the second textile sheet by folding consistent with FIGS. 24-28, and that the resulting package may then be wrapped within a virtual pouch consistent with FIGS. 18-23, with the resulting package being secured with the strap consistent with FIGS. 29-31. When the outer textile sheet defines the virtual pouch, it is preferable that no tacking be included whereby the outer textile sheet may be laid flat on a surface for receipt and unfolding of the interior folded textile sheet containing the textile article for purposes of avoiding contamination originating from the surface on which the unpacking is performed.

Accordingly, while the invention has been described herein in detail in relation to one or more preferred embodiments, it is to be understood that this disclosure is only illustrative and exemplary of the invention and is made merely for the purpose of providing a full and enabling disclosure of the invention. The foregoing disclosure is not intended to be construed to limit the invention or otherwise exclude any such other embodiments, adaptations, variations, modifications or equivalent arrangements, the invention being limited only by the claims appended hereto and the equivalents thereof.

What is claimed is:

1. A method of packaging textile articles, comprising:

(a) forming a package containing the textile article within a virtual pouch by:

(i) disinfecting and cleaning a first sheet of a textile material and a second sheet of a textile material;

(ii) folding the first sheet along at least one fold line to form one or more folds;

(iii) tacking the one or more folds to form the virtual pouch, wherein the tacking is formed with dissolvable stitching or adhesive and wherein the tacking is spaced from each edge of the first sheet and from a respective fold line of the at least one fold line;

(iii) inserting the textile article into an open end of the virtual pouch;

(iv) subsequently, folding the first sheet about the textile article such that the first sheet completely encloses the textile article;

(v) subsequently, folding the second sheet of textile material about the first sheet such that the second sheet completely encloses the first sheet, the textile article being completely enclosed by the first sheet; and (vi) subsequently, securing the second sheet in its disposition completely enclosing the first sheet, the textile article being completely enclosed within the first sheet, whereby the package is formed;

(b) removing the textile article from the package for use; and (c) after the removing of the textile article from the package for use, reusing the first sheet and the second sheet of textile material in performing the step of forming a package again, wherein the formed tacking is configured to dissolve during the step of disinfecting and cleaning.

2. The method of claim 1, wherein the textile article is completely contained within the virtual pouch.

3. The method of claim 1, further comprising sterilizing the package subsequent to performing the step of forming a package.

4. The method of claim 1, further comprising disinfecting and cleaning the textile article after use and reusing the textile article in performing the step of forming a package again.

5. The method of claim 1, wherein each of the first sheet, the second sheet, and the textile article is made from the same textile material.

6. The method of claim 1, wherein the tacking is performed by single-point stitching.

7. The method of claim 1, wherein the tacking is performed by double-point stitching.

8. The method of claim 1, wherein the tacking is performed by stitching a line on opposite sides of the virtual pouch.

9. The method of claim 1, wherein the tacking is performed by gluing.

10. The method of claim 1, wherein the tacking is performed by welding.

11. The method of claim 1, wherein the first sheet and the second sheet are coated with a waterproofing agent.

12. The method of claim 1, wherein the first sheet and the second sheet are rectangular and have the same dimensions and are made from the same material.

13. The method of claim 1, wherein the textile article is used in foodservice such as an apron.

14. The method of claim 1, wherein the textile article is used in foodservice such as a head covering.

15. The method of claim 1, wherein the textile article comprises a gown used in healthcare.

16. The method of claim 1, wherein the textile article comprises a surgical drape used in healthcare.

17. The method of claim 1, wherein the textile article comprises scrubs used in healthcare.

18. The method of claim 1, wherein the textile article comprises a sanitary piece of textile clothing worn by a healthcare provider.

19. The method of claim 1, wherein the textile article comprises a sanitary piece of textile clothing worn by a healthcare patient.

20. The method of claim 1, wherein the package does not comprise a bag.

* * * * *